US012690643B2

(12) United States Patent
Peyton

(10) Patent No.: US 12,690,643 B2
(45) Date of Patent: Jul. 28, 2026

(54) CUSHIONING ELEMENT FOR ARTICLE OF FOOTWEAR

(71) Applicant: NIKE, Inc., Beaverton, OR (US)

(72) Inventor: Lee D. Peyton, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 19/028,785

(22) Filed: Jan. 17, 2025

(65) Prior Publication Data

US 2025/0160481 A1 May 22, 2025

Related U.S. Application Data

(63) Continuation of application No. 18/529,440, filed on Dec. 5, 2023, now Pat. No. 12,225,969, which is a continuation of application No. 17/513,503, filed on Oct. 28, 2021, now Pat. No. 11,871,812.

(60) Provisional application No. 63/107,480, filed on Oct. 30, 2020.

(51) Int. Cl.
*A43B 13/20* (2006.01)
*A43B 17/03* (2006.01)

(52) U.S. Cl.
CPC ..... *A43B 13/20* (2013.01); *A43B 17/03* (2013.01)

(58) Field of Classification Search
CPC ..... A43B 13/20; A43B 21/265; A43B 21/28; A43B 23/029; A43B 17/03
USPC ..... 36/29
See application file for complete search history.

(56) References Cited

U.S. PATENT DOCUMENTS

| | | | | |
|---|---|---|---|---|
| 1,504,908 | A | 8/1924 | Sato | |
| 2,677,906 | A * | 5/1954 | Reed | A43B 17/03 36/153 |
| 4,999,931 | A * | 3/1991 | Vermeulen | A43B 13/185 36/153 |
| 5,718,063 | A * | 2/1998 | Yamashita | A43B 1/0072 36/35 B |
| 5,918,383 | A | 7/1999 | Chee | |
| 6,402,879 | B1 * | 6/2002 | Tawney | A43B 21/285 36/35 R |
| 6,971,193 | B1 | 12/2005 | Potter et al. | |
| 7,244,483 | B2 | 7/2007 | Tawney et al. | |
| 9,603,414 | B2 | 3/2017 | Taylor et al. | |

(Continued)

FOREIGN PATENT DOCUMENTS

| | | |
|---|---|---|
| WO | WO-9111931 A1 | 8/1991 |
| WO | WO-2016172169 A1 | 10/2016 |

OTHER PUBLICATIONS

European Patent Office (ISA), International Search Report and Written Opinion for PCT App. No. PCT/US2021/057351, mailed Mar. 2, 2022.

(Continued)

*Primary Examiner* — Marie D Bays
(74) *Attorney, Agent, or Firm* — Honigman LLP; Matthew H. Szalach

(57) ABSTRACT

A cushioning element for an article of footwear includes a bladder having a first barrier layer and a second barrier layer joined together along a seam to define a chamber and a support element disposed within the chamber and having a support member and a plurality of flexible support legs each extending from a first end attached to the support member to a second end disposed between the first barrier layer and the second barrier layer within the seam.

20 Claims, 14 Drawing Sheets

(56) References Cited

U.S. PATENT DOCUMENTS

| | | | | |
|---|---|---|---|---|
| 9,603,415 | B2 | 3/2017 | Taylor et al. | |
| 9,730,487 | B2 | 8/2017 | Davison | |
| 10,376,016 | B2 | 8/2019 | Davison | |
| 10,791,795 | B2 | 10/2020 | Campos et al. | |
| 11,013,294 | B2 | 5/2021 | Davison | |
| 11,871,812 | B2 * | 1/2024 | Peyton | A43B 23/0285 |
| 2001/0042321 | A1 * | 11/2001 | Tawney | A43B 13/20 36/43 |
| 2002/0139471 | A1 | 10/2002 | Tawney et al. | |
| 2008/0005929 | A1 | 1/2008 | Hardy et al. | |
| 2008/0184600 | A1 | 8/2008 | Yang | |
| 2011/0203133 | A1 | 8/2011 | Peyton | |
| 2014/0259749 | A1 | 9/2014 | Taylor et al. | |
| 2015/0113829 | A1 * | 4/2015 | Kodad | A43B 13/141 383/105 |
| 2016/0295968 | A1 | 10/2016 | Campos, II et al. | |
| 2017/0035146 | A1 | 2/2017 | Peyton | |
| 2018/0070675 | A1 * | 3/2018 | Campos, II | A43B 13/14 |
| 2018/0332925 | A1 * | 11/2018 | Bailey | B32B 27/08 |
| 2018/0338575 | A1 | 11/2018 | Elder et al. | |
| 2018/0338577 | A1 * | 11/2018 | Elder | A43B 3/0057 |
| 2018/0338578 | A1 * | 11/2018 | Elder | A43B 3/0052 |
| 2019/0365039 | A1 * | 12/2019 | Auyang | A43B 13/39 |
| 2020/0154825 | A1 * | 5/2020 | Case | A43B 13/206 |

OTHER PUBLICATIONS

European Patent Office, PCT International Search Report/Written Opinion for application No. PCT/US2021/031946, dated Aug. 4, 2021.

USPTO, Non-Final Office Action for U.S. Appl. No. 17/317,793, mailed Jan. 26, 2023.

USPTO, Final Office Action for U.S. Appl. No. 17/317,793, mailed Aug. 1, 2023.

* cited by examiner

CUSHIONING ELEMENT FOR ARTICLE OF FOOTWEAR

CROSS REFERENCE TO RELATED APPLICATIONS

This application is a continuation of U.S. application Ser. No. 18/529,440, filed on Dec. 5, 2023, which is a continuation of U.S. application Ser. No. 17/513,503, filed on Oct. 28, 2021, which claims priority under 35 U.S.C. § 119(e) to U.S. Provisional Application No. 63/107,480, filed on Oct. 30, 2020. The disclosures of these prior applications are considered part of the disclosure of this application and are hereby incorporated by reference in their entirety.

FIELD

The present disclosure relates generally to cushioning for articles of footwear, and to methods of making cushioning elements for articles of footwear.

BACKGROUND

This section provides background information related to the present disclosure, which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally incorporate a fluid-filled chamber to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a stroble attached to the upper and disposed between the midsole and the insole or sockliner.

Fluid-filled chambers for use in footwear are typically formed from two barrier layers of polymer material that are sealed or bonded together to form a chamber. Often, the chamber is pressurized with a fluid, such as air, and may incorporate tensile members to retain a desired shape of the chamber when pressurized. Generally, fluid-filled chambers are designed with an emphasis on balancing support for the foot and cushioning characteristics that relate to responsiveness as the fluid-filled chamber resiliently compresses under an applied load. The fluid-filled chamber as a whole, however, fails to adequately dampen oscillations by the foot as the fluid-filled chamber compresses to attenuate ground-reaction forces. Accordingly, creating a midsole from a fluid-filled chamber that dampens foot oscillation and provides acceptable cushioning for the foot while attenuating ground-reaction forces is difficult to achieve.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
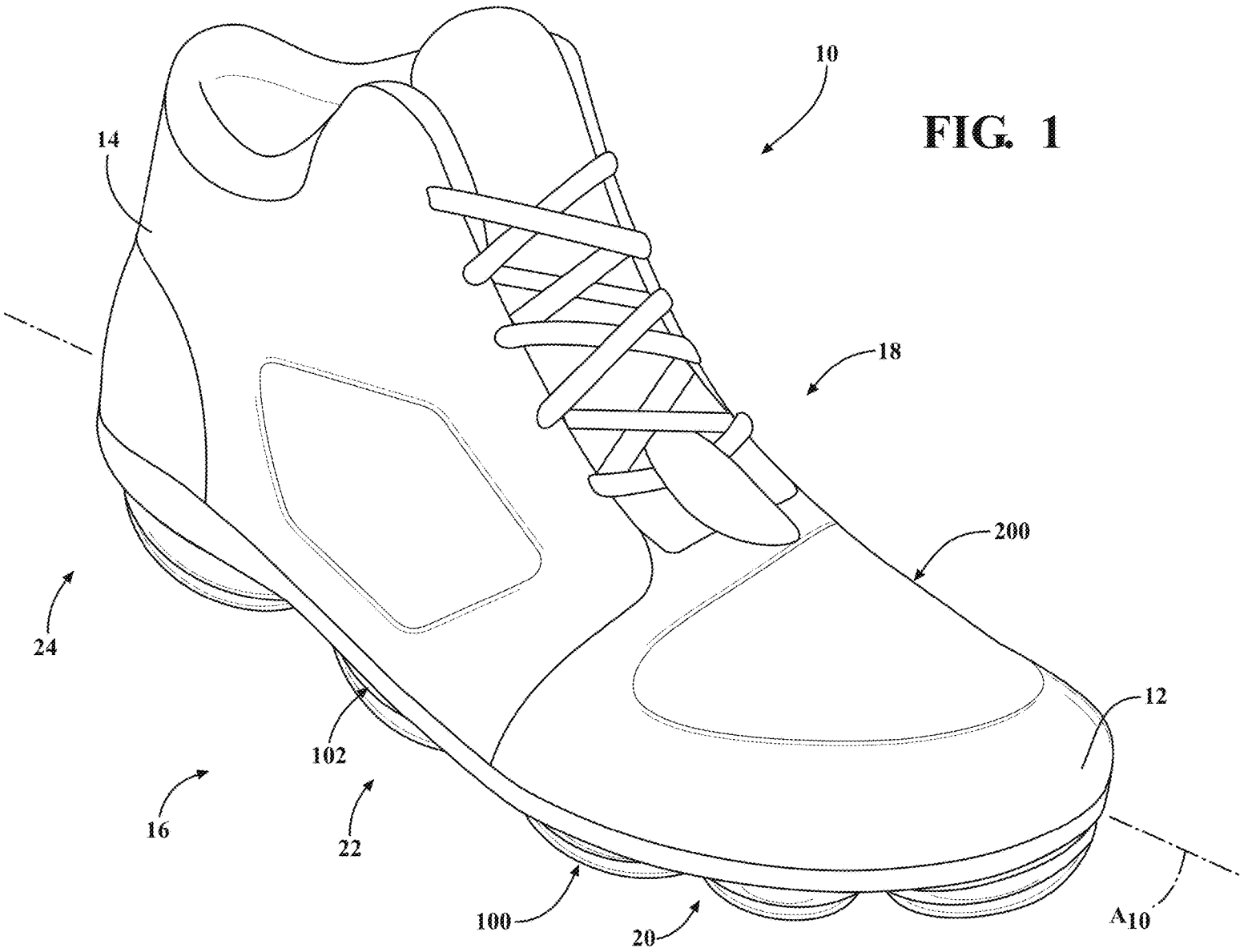
FIG. 1 is a perspective view of an article of footwear including a sole structure in accordance with the principles of the present disclosure.
Figure 2:
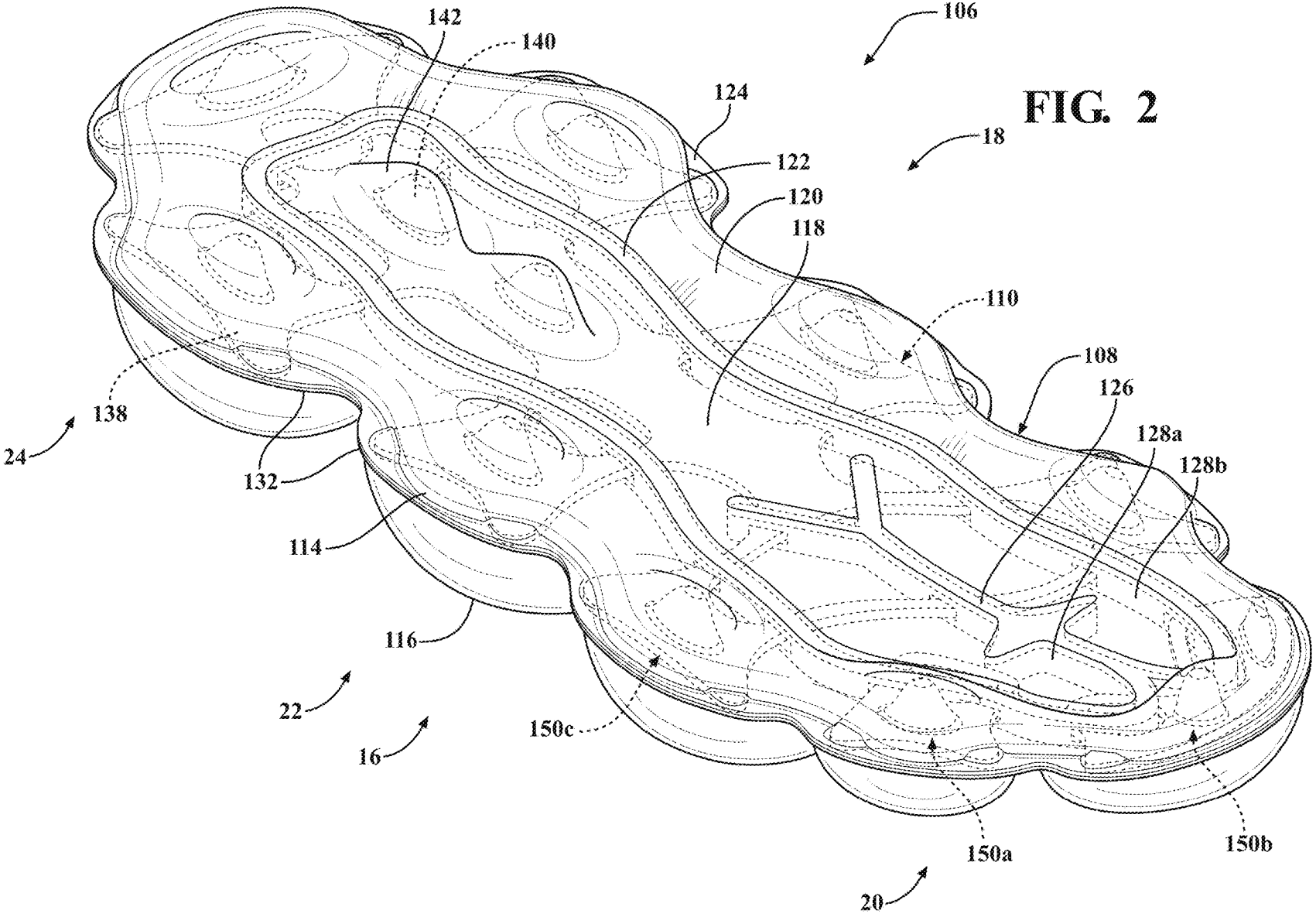
FIG. 2 is a perspective view of a cushioning element for a sole structure in accordance with the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, a cushioning element for an article of footwear includes a bladder having a first barrier layer and a second barrier layer joined together along a seam to define a chamber and a support element disposed within the chamber and having a support member and a plurality of flexible support legs each extending from a first end attached to the support member to a second end disposed between the first barrier layer and the second barrier layer within the seam.

The cushioning element may include one or more of the following optional features. For example, the support element may be operable between a flat configuration when the bladder is in a deflated state and an erect configuration when the bladder is in an inflated state. In the erect configuration, the second end of each of the support legs may be biased towards the second end of at least one of the other support legs. Additionally or alternatively, the support element may be biased towards the first barrier layer and away from the second barrier layer.

In one configuration, the seam may be a peripheral seam extending around an outer periphery of the bladder and may form a plurality of tabs. The second end of each of the support legs may be secured between the first barrier layer and the second barrier layer within one of the tabs. Additionally or alternatively, the second end of each of the support legs may include an anchor captured within one of the tabs.

The support member may include a support pillar extending towards the first barrier layer from the support member to a distal end. In this configuration, the first barrier layer may conform to the distal end of the support pillar and may form a protuberance in the first barrier layer.

Each of the first barrier layer and the second barrier layer may include a striated polymeric material.

In another configuration, a cushioning element for an article of footwear includes a support element having a support member and a plurality of support legs each extending from a first end attached to an outer periphery of the support member to a distal end, each of the support legs including a portion that is flexible relative to the support member. Additionally, the cushioning element includes a first barrier layer and a second barrier layer joined together along a peripheral seam, the distal end of each of the support legs being secured within the peripheral seam.

The cushioning element may include one or more of the following optional features. For example, the support element may be operable between a flat configuration when the bladder is in a deflated state and an erect configuration when the bladder is in an inflated state. In the erect configuration, the distal end of each of the support legs may be biased towards the distal end of at least one of the other support legs. Additionally or alternatively, in the erect configuration, the support member may be biased towards the first barrier layer and away from the second barrier layer.

In one configuration, the peripheral seam may extend around an outer periphery of the bladder and may form a plurality of tabs. Additionally or alternatively, the distal end of each of the support legs may be secured between the first barrier layer and the second barrier layer within one of the tabs. Further, the distal end of each of the support legs may include an anchor captured within one of the tabs.

The support member may include a support pillar extending from the support member to a distal end. In this configuration, the first barrier layer may conform to the distal end of the support pillar and may form a protuberance in the first barrier layer.

Each of the first barrier layer and the second barrier layer may include a striated polymeric material.

An article of footwear may incorporate the cushioning element described above.

A method of forming a cushioning element for an article of footwear is provided and includes the steps of (i) forming a support element including a support member and a plurality of support legs extending outwardly from a first end attached to an outer periphery of the support member to a terminal distal end, (ii) providing a first barrier layer on a first side of the support element, (iii) providing a second barrier layer on an opposite side of the support element than the first barrier layer, (iv) joining the first barrier layer to the second barrier layer along a peripheral seam to form a bladder, the support element disposed within the bladder and the terminal distal end of each of the support legs secured within the peripheral seam, and (v) inflating the bladder with a pressurized fluid to bias the support element of the support member towards the first barrier layer.

The details of one or more implementations of the disclosure are set forth in the accompanying drawings and the description below. Other aspects, features, and advantages will be apparent from the description, the drawings, and the claims.

Referring to FIG. 1, an example of an article of footwear 10 according to the present disclosure is shown. The article of footwear 10 includes a sole structure 100 and an upper 200 attached to the sole structure 100. The footwear 10 may further include an anterior end 12 associated with a forward-most point of the footwear 10, and a posterior end 14 corresponding to a rearward-most point of the footwear 10. As shown in FIG. 1, a longitudinal axis $A_{10}$ of the footwear 10 extends along a length of the footwear 10 from the anterior end 12 to the posterior end 14 parallel to a ground surface, and generally divides the footwear 10 into a lateral side 16 and a medial side 18. Accordingly, the lateral side 16 and the medial side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 18 to the lateral side 16.

The article of footwear 10 may be divided into one or more regions. The regions may include a forefoot region 20, a mid-foot region 22, and a heel region 24. The forefoot region 20 may be subdivided into a toe portion $\mathbf{20}_T$ corresponding with phalanges and a ball portion $\mathbf{12}_B$ associated with metatarsal bones of a foot. The mid-foot region 22 may correspond with an arch area of the foot, and the heel region 24 may correspond with rear portions of the foot, including a calcaneus bone.

Figure 4A:
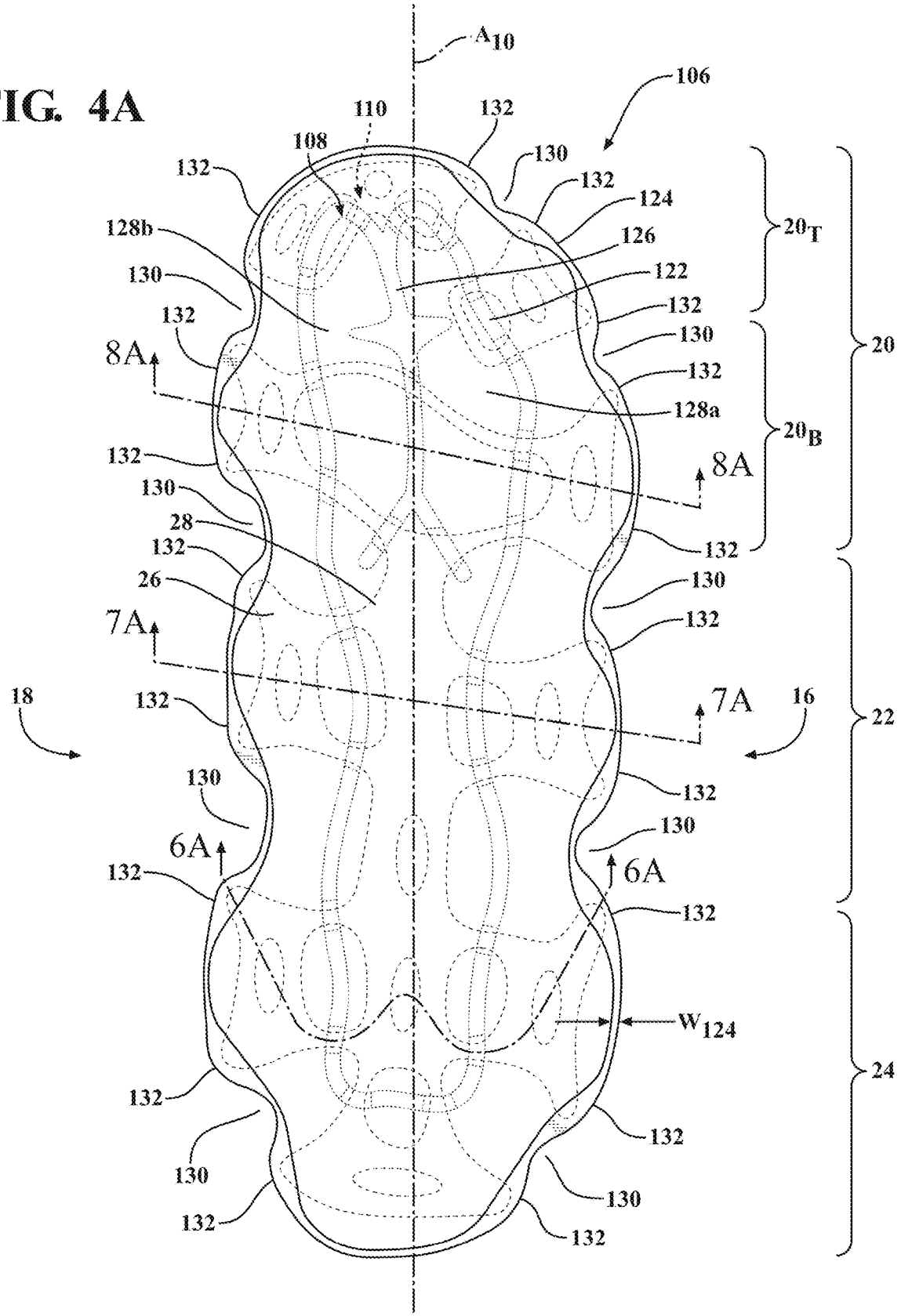
FIG. 4A is a top plan view of the cushioning element of FIG. 2, showing the cushioning element in the flattened configuration.
Figure 4B:
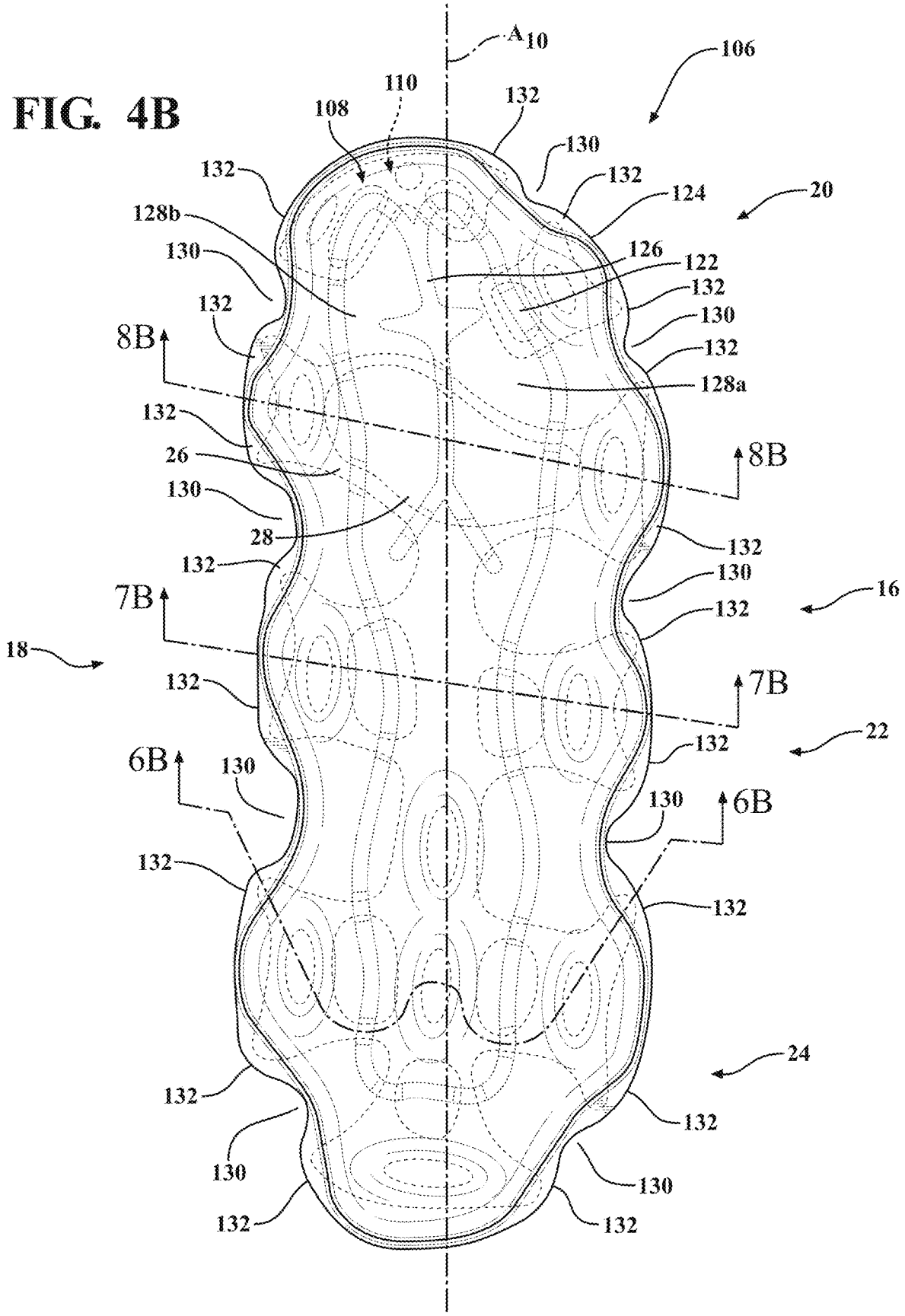
FIG. 4B is a top plan view of the cushioning element of FIG. 2, showing the cushioning element in the erect configuration.

The article of footwear 10, and more particularly, the sole structure 100, may be further described as including a peripheral region 26 and an interior region 28, as indicated in FIGS. 4A and 4B. The peripheral region 26 is generally described as being a region between the interior region 28 and an outer perimeter of the sole structure 100. Particularly, the peripheral region 26 extends from the forefoot region 20 to the heel region 24 along each of the medial side 18 and the lateral side 16, and wraps around each of the forefoot region 20 and the heel region 24. The interior region 28 is circumscribed by the peripheral region 26, and extends from the forefoot region 20 to the heel region 24 along a central portion of the sole structure 100. Accordingly, each of the forefoot region 20, the mid-foot region 22, and the heel region 24 may be described as including the peripheral region 26 and the interior region 28.

Referring now to FIGS. 2-8B, the sole structure 100 includes a midsole 102 configured to provide cushioning characteristics to the sole structure 100, and an outsole 104 configured to provide a ground-engaging surface of the article of footwear 10. The midsole 102 includes a cushioning element 106 having a bladder 108 and a support element 110 disposed within the bladder 108. Optionally, the midsole 102 may include a filler element 112 disposed adjacent to an upper portion of the cushioning element 106, as discussed in greater detail below.

As shown in the cross-sectional views of FIGS. 6A-8B, the bladder 108 may be formed by an opposing pair of barrier layers 114, 116, which can be joined to each other at discrete locations to define an overall shape of the bladder 108. Alternatively, the bladder 108 can be produced from any suitable combination of one or more barrier layers. As used herein, the term "barrier layer" (e.g., barrier layers 114, 116) encompasses both monolayer and multilayer films. In some embodiments, one or both of the barrier layers 114, 116 are each produced (e.g., thermoformed or blow molded) from a monolayer film (a single layer). In other embodiments, one or both of the barrier layers 114, 116 are each produced (e.g., thermoformed or blow molded) from a multilayer film (multiple sublayers). In either aspect, each layer or sublayer can have a film thickness ranging from about 0.2 micrometers to about be about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers 114, 116 can independently be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 114, 116 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like. Optionally, the barrier layers 114, 116 may be include a reinforced composite material including one or more fibrous materials embedded within an elastomeric material. For example, a plurality of parallel strands of a polymeric material, such as Kevlar® or Dyneema® composite fabrics, may be integrated onto or within the material of one or both of the barrier layers 114, 116 to allow for a thinner barrier layer 114, 116.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials, as well as with the TPU copolymers described herein and optionally including combinations of polyimides and crystalline polymers, are also suitable.

The barrier layers 114, 116 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entireties. In embodiments where the barrier layers 114, 116 include two or more sublayers, examples of suitable multilayer films include microlayer films, such as those disclosed in Bonk et al., U.S. Pat. No. 6,582,786, which is incorporated by reference in its entirety. In further embodiments, the barrier layers 114, 116 may each independently include alternating sublayers of one or more TPU copolymer materials and one or more EVOH copolymer materials, where the total number of sublayers in each of the barrier layers 114, 116 includes at least four (4) sublayers, at least ten (10) sublayers, at least twenty (20) sublayers, at least forty (40) sublayers, and/or at least sixty (60) sublayers.

The bladder 108 can be produced from the barrier layers 114, 116 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 114, 116 can be produced by co-extrusion followed by vacuum thermoforming to form the profile of the bladder 108, which can optionally include one or more valves (e.g., one way valves) that allows the bladder 108 to be filled with the fluid (e.g., gas).

The bladder 108 desirably has a low gas transmission rate to preserve its retained gas pressure. In some embodiments, the bladder 108 has a gas transmission rate for nitrogen gas that is at least about ten (10) times lower than a nitrogen gas transmission rate for a butyl rubber layer of substantially the same dimensions. In an aspect, bladder 108 has a nitrogen gas transmission rate of 15 cubic-centimeter/square-meter·atmosphere·day ($cm^3/m^2$·atm·day) or less for an average film thickness of 500 micrometers (based on thicknesses of barrier layers 114, 116). In further aspects, the transmission rate is 10 $cm^3/m^2$·atm·day or less, 5 $cm^3/m^2$·atm·day or less, or 1 $cm^3/m^2$·atm·day or less.

In the illustrated example, the interior surfaces of the barrier layers 114, 116 are joined together at discrete locations to define a plurality of chambers 118, 120. As shown in FIGS. 6B, 7B, and 8B, the upper and lower barrier layers 114, 116 are spaced apart from each other to define respective interior voids of each of the chambers 118, 120, while the barrier layers 114, 116 are joined or attached to each other to form an interior seam 122 and a peripheral seam 124 surrounding each of the chambers 118, 120.

In the illustrated example, the bladder 108 includes a first, interior chamber 118 disposed in the interior region 28 of the bladder 108 and a second, peripheral chamber 120 surrounding the interior chamber 118. The interior seam 122 surrounds the interior chamber 118 and separates the interior chamber 118 from the peripheral chamber 120. In the illustrated example, the interior seam 122 is discontinuous and includes a plurality of seam portions that are intersected by portions of the support element 110, as discussed below. In other examples, interior seam 122 may be continuous, such that the interior voids of the interior chamber 118 and the peripheral chamber 120 are fluidly isolated from each other (i.e., fluid or media cannot transfer between the interior voids). As shown, the interior seam 122 includes an anterior leg 126 extending from an anterior end of the interior chamber 118 and separating the anterior end of the interior chamber 118 into a parallel pair of elongate sub-chambers 128*a*, 128*b*. The sub-chambers 128*a*, 128*b* may be described as forming a pair of finger-shaped chambers 128*a*, 128*b* at the anterior end of the interior chamber 118.

The peripheral seam 124 extends around the outer periphery of the peripheral chamber 120 and defines an outer peripheral profile of the bladder 108. As shown, the peripheral profile of the bladder 108 may be undulated and defines a series of reliefs 130 formed around the outer periphery of the bladder 108. As best shown in FIG. 4A, the peripheral seam 120 may have a variable width $W_{120}$ along the outer periphery of the bladder 108. Portions of the peripheral seam 120 having the greater width $W_{120}$ define a plurality of tabs 132 around the outer periphery of the bladder 108. In the illustrated example, the width $W_{120}$ of the peripheral seam 124 is greater at opposite ends of each of the reliefs 130 such that each relief 130 includes a pair of the tabs 132 formed by the wider portions of the peripheral seam 124. In other examples, one or more of the reliefs 130 may not include the tabs 132, or may include a single one of the tabs 132. While the illustrated example is shown with the undulated outer periphery including the reliefs 130, the bladder 108 may be formed with a substantially continuous outer periphery without the reliefs, whereby one or more of the tabs 132 project outwardly from the outer periphery of the bladder 108.

Figure 3A:
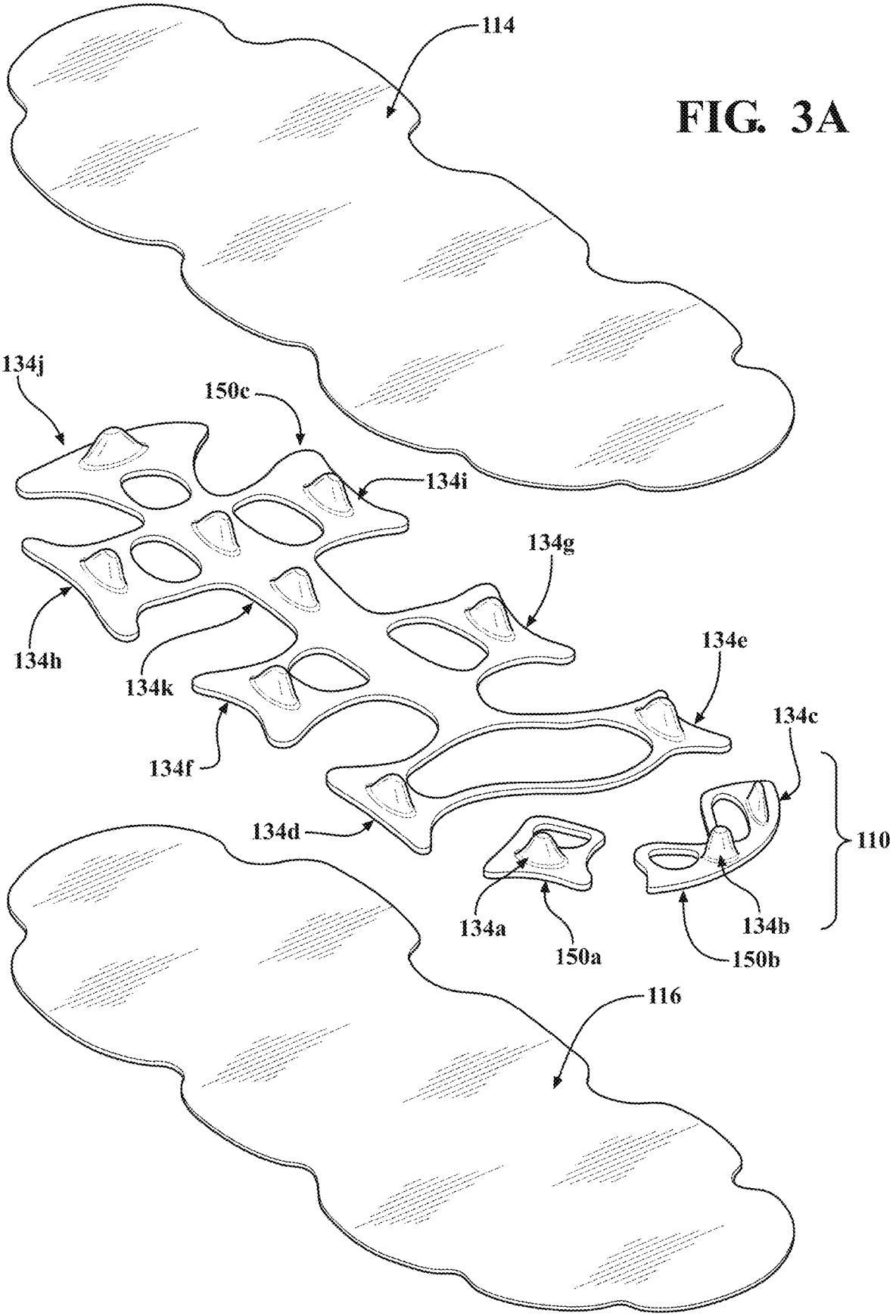
FIG. 3A is an exploded view of the cushioning element of FIG. 2, showing the components of the cushioning element in a flattened configuration.
Figure 3B:
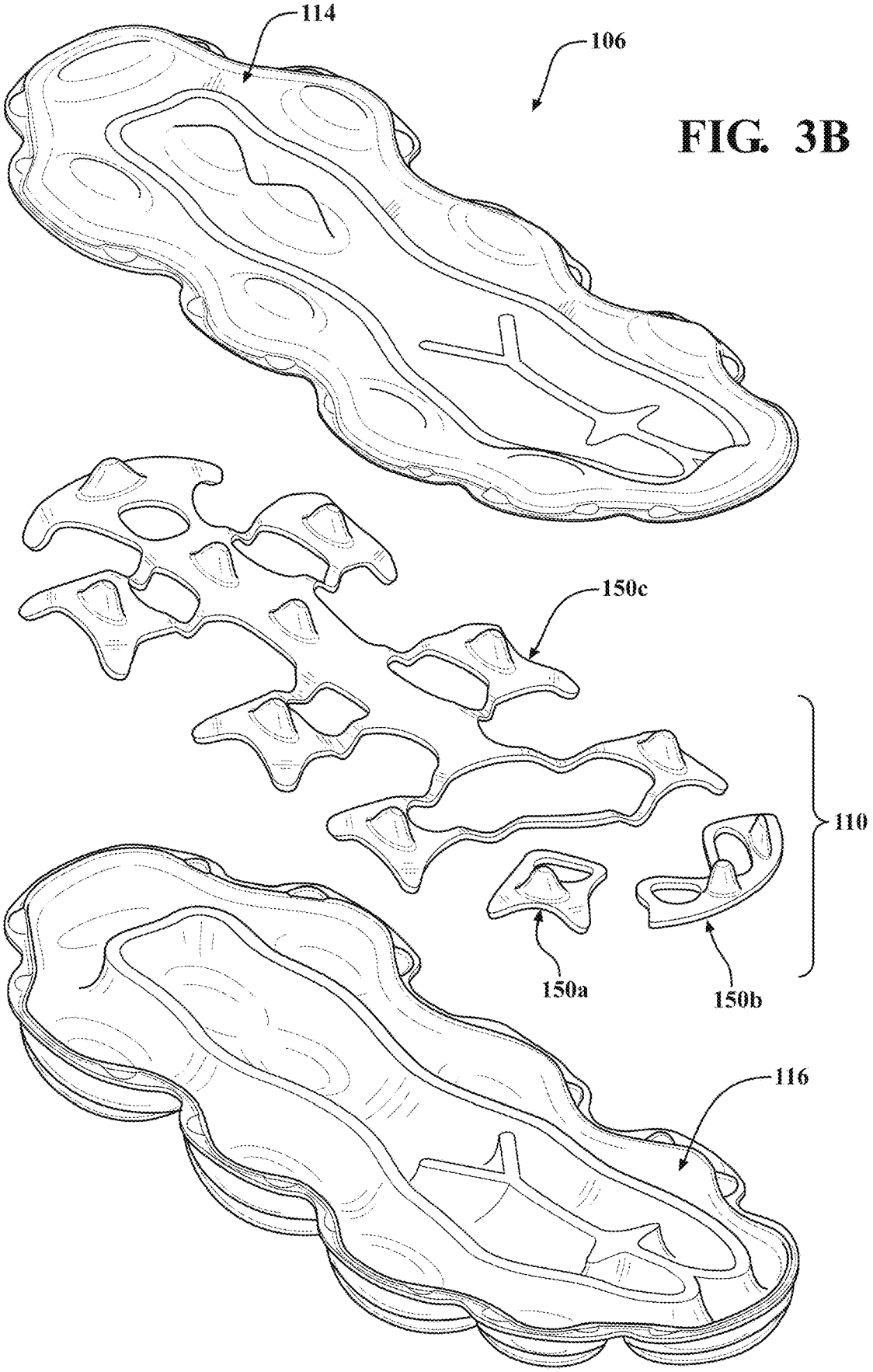
FIG. 3B is an exploded perspective view of the cushioning element of FIG. 2, showing the components of the cushioning element in an erect configuration.

Referring now to FIGS. 3A and 3B, the support element 110 of the cushioning element 106 includes a plurality of truss elements 134*a*-134*k*, which are each operable between a flat configuration (FIG. 3A) and an erect configuration (FIG. 3B). Each of the truss elements 134*a*-134*k* includes an interior support member 136*a*-136*k* and a plurality of flexible support legs 138*a*, 138*b* extending from an outer periphery of each support member 136*a*-136*k*. Optionally, one or more of the truss elements 134*a*-134*k* includes one or more support pillars 140 protruding from a top surface of the support member 136*a*-136*k*.

The support element 110 includes materials having a greater hardness than the materials included in the barrier layers 114, 116 of the bladder 108, such that the support element 110 forms a skeleton or frame within the bladder 108 when the bladder 108 is inflated.

Generally, each of the support members 136*a*-136*k* is configured to be disposed within one of the chambers 118, 120 and to support the upper barrier layer 114 when the support element 110 is in the erect configuration, as shown in FIGS. 6B, 7B, and 8B. The support legs 138*a*, 138*b* are configured to be secured between the barrier layers 114, 116 within the seams 122, 124 of the bladder 108, and flex to facilitate transitioning the support element 110 from the flat configuration to the erect configuration. Where present, distal ends of the support pillars 140 are biased against an interior surface of the upper barrier layer 114 and form a plurality of protuberances 142 on a top side of the bladder 108 when the truss elements 134*a*-134*k* are in the erect configuration.

Each of the support legs 138*a*, 138*b* extends from a first end 144 attached to the outer periphery of one of the support members 136*a*-136*k* to a distal second end 146 disposed between the barrier layers 114, 116 within one of the seams. As best shown in FIGS. 4A and 4B, the second ends of adjacent ones of the truss elements 134*a*-134*k* may be connected to each other within the interior seam 122. For example, the second ends of legs of one of the support members 146*c*-146*i* disposed within the peripheral chamber 120 may be connected to the second ends of legs of one of the support members 146*j*, 146*k* disposed within the interior chamber 122 within the interior seam 124.

The illustrated support element 110 includes various examples of configurations for truss elements 134*a*-134*j*. These different configurations of truss elements 134*a*-134*j* are provided for illustrative purposes, and are not intended to specifically limit configurations of the support element 110 to the configuration shown. For example, the support element 110 of the illustrated example includes different examples of support structures 150*a*-150*c* formed by the truss elements 134*a*-134*k*. Examples of the support structures 150*a*-150*c* include independent support structures 150*a* having a single one of the truss elements 134*a*, tandem support structures 150*b* including a pair of the truss elements 134*b*, 134*c*, and a webbed support structure 150*c* including a series or network of the truss elements 134*d*-134*k*. The principles of the present disclosure may be realized by implementing any one of the support structures 150*a*-150*c* alone or in combination with other support structures 150*a*-150*c*.

Figure 5:
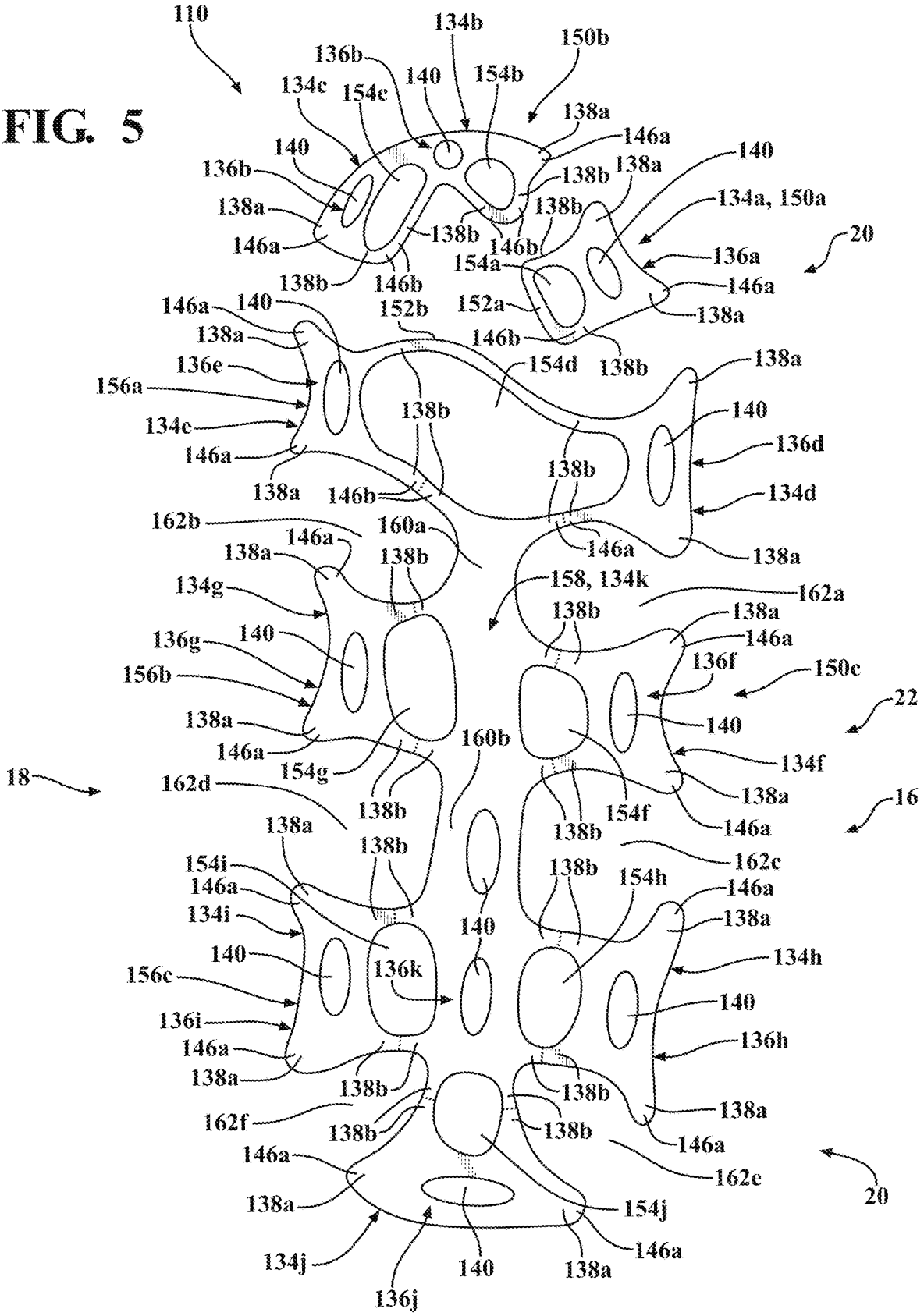
FIG. 5 is a top plan view of a support element for the cushioning element of FIG. 2.

With reference to FIG. 5, the support element 110 includes one of the independent support structures 150*a* disposed in the toe portion $\mathbf{20}_T$ on the lateral side 16. The independent support structure 150*a* includes one of the truss elements 134*a* including a support member 136*a* and a plurality of legs 138*a*, 138*b* extending from different sides of the support member 136*a*. Specifically, the truss element 134*a* of the support structure 150*a* includes a first pair of the legs 138*a*, 138*b* extending to terminal second ends 146*a*, 146*b* configured to be received within the peripheral seam 124 and a second pair of the legs 138*a*, 138*b* extending to terminal second ends 146*a*, 146*b* configured to be received within the interior seam 122. Unlike the first pair of outer legs 138*a*, which terminate and have independent second ends 146*a*, 146*b*, the second ends 146*a*, 146*b* of the inner legs 138*b* are connected to each other by a link 152*a*. The support member 136*a*, the inner legs 138*a*, and the link 152*a* cooperate to define an opening 154*a*. As shown in FIGS. 4A and 4B, the barrier layers 114, 116 may be joined together at the interior seam 122 within the opening 154*a* to capture the inner legs 138*b* of the second pair of legs 138*b*.

With continued reference to FIG. 5, an example of a tandem support structure 150*b* is shown arranged in the toe portion $\mathbf{20}_T$ on the medial side 18. The tandem support structure 150*b* includes a pair of truss elements 134*b*, 134*c* configured to be received within the peripheral chamber 120. The first truss element 134*b* includes a first outer leg 138*a* extending to a terminal second end 146*a* configured to be received within the peripheral seam 124 and a first pair of inner legs 138*b* extending to second ends 146*b* configured to be received within the interior seam 122. The distal second ends 146*b* of the inner legs 138*b* of the truss element 138*b* are connected to each other to define an opening 154*b*, within which the barrier layers 114, 116 are joined together to form a portion of the interior seam 122. The tandem support structure 150*b* also includes a second one of the truss elements 134*c* having a support member 136*c*, a second outer leg 138*a* extending to a terminal second end 146*a* configured to be received within the peripheral seam 124, and a second pair of inner legs 138*b* extending to second ends 146*b* configured to be received within the interior seam 122. As with the first truss element 134*b*, the second ends 146*a* of the inner legs 138*b* of the second truss element 136*b* are connected to each other to define an opening 154*c* within which the barrier layers 114, 116 are joined together to form a portion of the interior seam 122.

The illustrated example of the webbed support structure 150*c* extends from the ball portion $\mathbf{20}_B$ of the forefoot region 20 to the posterior end 14, and includes a network of the truss elements 134*d*-135*l* connected to each other by inner legs 138*b*. In the illustrated example, the webbed support structure 150*c* includes a plurality of laterally-extending ribs 156*a*-156*c* arranged in series and connected by a central spine 158 extending along a length of the support structure 150*c*. Each of the ribs 156*a*-156*c* of the illustrated support structure 150*c* is configured differently to illustrate different examples of ribs 156*a*-156*c* that may be included in a webbed support structure 150*c*. In some examples, a webbed support structure may include a plurality of any one of the examples of the ribs 156*a*-156*c*. For example, a webbed support structure may have the same configuration of the ribs 156*a*-156*c*, or may include any quantity or combination of the ribs 156*a*-156*c*.

A first one of the ribs 156*a* is shown disposed in the ball portion $\mathbf{20}_B$ of the cushioning element 106 and includes a first truss element 134*d* disposed in the peripheral chamber 120 on the lateral side 16 and a second truss element 134*e* disposed in the peripheral chamber 120 on the medial side 18. Each of the truss elements 134*d*, 134*e* includes a pair of outer legs 138*a* extending to terminal second ends 146*a* configured to be received within the peripheral seam 124 and a pair of inner legs 138*b* extending to second ends 146*b* configured be received within the interior seam 122. At an anterior end of the webbed support structure 150*c*, corresponding inner legs 138*b* of the truss elements 134*d*, 134*e* may be connected to each other by a link 152*b* that extends across a width of the interior chamber 118. Additionally, each of the truss elements 134*d*, 134*e* includes an inner leg 138*b* connected to a corresponding inner leg 138*b* of the spine 158 within the interior seam 122. The inner legs 138*b*, the link 152*b*, and an end of the spine 158 cooperate to define an opening 154*d* in the first rib 156*c*, which extends across a width of the interior chamber 118. The support members 136*d*, 136*e* of each of the truss elements 134*d*, 134*e* includes one of the support pillars 140.

With continued reference to FIGS. 4A-5, a second one of the ribs 156*b* is disposed in the mid-foot region 22 and includes a first truss element 134*f* disposed in the peripheral chamber 120 on the lateral side 16 and a second truss element 134*g* disposed in the peripheral chamber 120 on the medial side 18. Each of the truss elements 134*f*, 134*g* includes a pair of outer legs 138*a* extending to terminal second ends 146*a* configured to be received within the peripheral seam 124 and a pair of inner legs 138*b* extending to second ends 146*b* configured be received within the interior seam 122. Each of the inner legs 138*b* of the truss elements 134*f*, 134*g* is connected to a corresponding inner leg 138*b* of the spine 158 within the interior seam 122. The inner legs 138*b*, the support members 136*f*, 136*g*, and the spine 158 cooperate to define a pair of openings 154*f*, 154*g* on opposite sides of the spine 158. The barrier layers 114, 116 are joined together within the openings 154*f*, 154*g* to form portions of the interior seam 122. The support members 136*f*, 136*g* of each of the truss elements 134*f*, 134*g* include one of the support pillars 140, while a central portion of the rib 156*b* formed by the spine 158 is flat and does not include a support pillar 140.

In another example, a third one of the ribs 156*c* is disposed in the mid-foot region 22 and includes a first truss element 134*h* disposed in the peripheral chamber 120 on the lateral side 16 and a second truss element 134*i* disposed in the peripheral chamber 120 on the medial side 18. Each of the truss elements 134*h*, 134*i* includes a pair of outer legs 138*a* extending to terminal second ends 146*a* configured to be received within the peripheral seam 124 and a pair of inner legs 138*b* extending to second ends 146*b* configured to be received within the interior seam 122. Each of the inner legs 138*b* the truss elements 134*h*, 134*i* is connected to a corresponding inner leg 138*b* of the spine 158 within the interior seam 122. The inner legs 138*b*, the support members 136*h*, 136*i*, and the spine 158 cooperate to define a pair of openings 154*h*, 154*i* on opposite sides of the spine 158. The barrier layers 114, 116 are joined together within the openings 154*h*, 154*i* to form portions of the interior seam 122. The support members 136*h*, 136*i* of each of the truss elements 134*h*, 134*i* include one of the support pillars 140, while a central portion of the rib 156*b* formed by the spine 158 includes a third support pillar 140 that is aligned with the support pillars 140 of the truss elements 134*h*, 134*i* along a lateral direction (i.e., across a width of the support structure 150*c*).

A posterior end of the webbed support structure 150*c* includes a truss element 134*j* disposed in the peripheral chamber 120 at the posterior end 14. The truss element 134*j* includes a pair of outer legs 138*a* extending to terminal second ends 146*a* configured to be received within the peripheral seam 124 and a pair of inner legs 138*b* extending to second ends 146*b* configured be received within the interior seam 122. Each of the inner legs 138*b* of the truss element 134*j* is connected to a corresponding inner leg 138*b* of the spine 158 within the interior seam 122. The inner legs 138*b*, the support member 136*j*, and the spine 158 cooperate to define an opening 154*j* within which the barrier layers 114, 116 are joined together to form a portion of the interior seam.

As discussed above, the spine 158 may be described as forming interior portions of each of the ribs 156*a*-156*b*. Alternatively the inner spine 158 may be described as a continuous feature that connects all of the peripheral truss elements 134*d*-134*j* together and defines an interior truss element 134*k* extending from the first rib 156*a* to the posterior truss element 134*j*. As shown, the interior truss element 134*k* includes a first connecting segment 160*a* extending from the first rib 156*a* to the second rib 156*b* and a second connecting segment 160*b* extending from the second rib 156*b* to the third rib 156*c*. Here, the second connecting segment 160*b* includes one of the support pillars 140. In other examples, any of the connecting segments 160*a*, 160*b* may be formed with or without support pillars 140.

Referring still to FIG. 5, adjacent ones of the peripheral truss elements 134*d*-134*j* of the webbed support structure 150*c* are spaced apart from each other by a series of gaps 162*a*-162*f*. The gaps 162*a*-162*f* correspond to positions of some of the reliefs 130 formed in the outer periphery of the bladder 108. Accordingly, the peripheral seam 124 may extend into the gaps 162*a*-162*f* between adjacent ones of the peripheral truss elements 134*d*-134*j* to form the undulated profile of the bladder 108.

With reference to FIGS. 6A-8B, cross-sectional views are taken across a width of the cushioning element 106 and show one example of the relationship between the bladder 108 and the support element 110 when the bladder 108 is inflated and the support element 110 is moved from the flattened state (FIGS. 6A, 7A, 8A) to the erect configuration (FIGS. 6B-8B). As shown, each of the support legs 138*a*, 138*b* extends from a first end 144*a*, 144*b* that is attached to the outer periphery of a respective one of the support members 136*a*-136*k* to one of the second ends 146*a*, 146*b* that is secured between the barrier layers 114, 116 at one of the seams 122, 124.

Figure 6A:
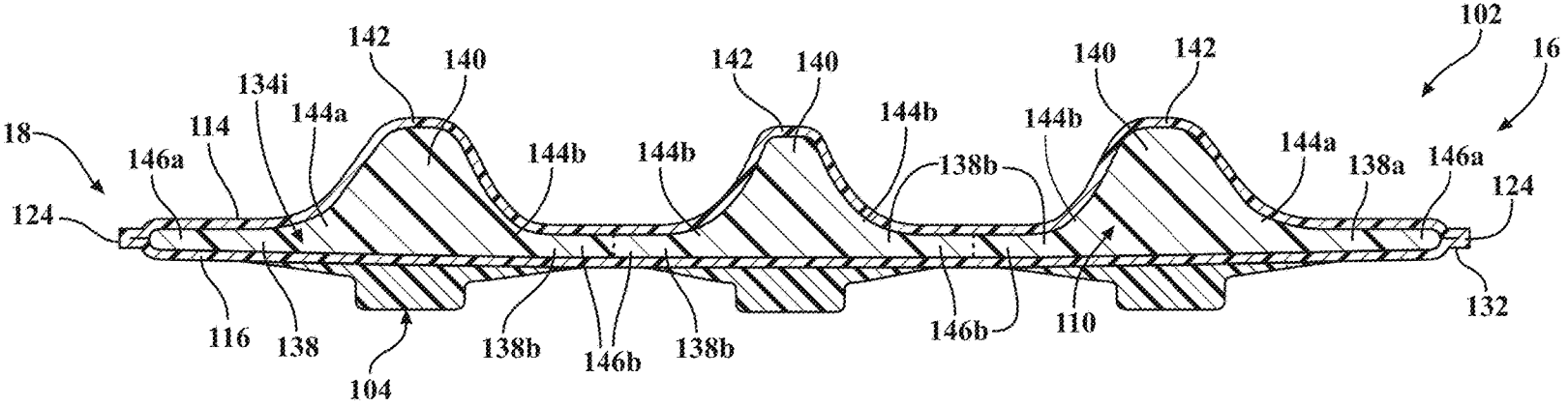
FIG. 6A is a cross-sectional view of the cushioning element of FIG. 2, taken along Line 6A-6A in FIG. 4A.
Figure 6B:
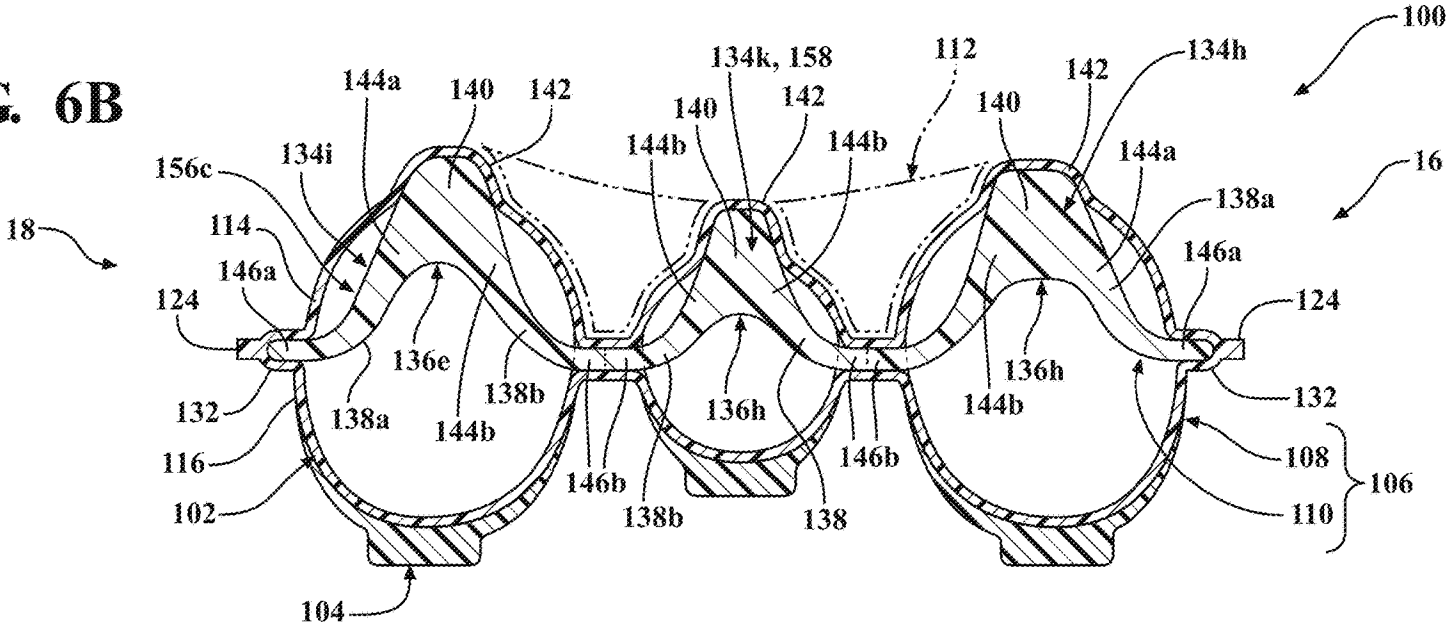
FIG. 6B is a cross-sectional view of the cushioning element of FIG. 2, taken along Line 6B-6B in FIG. 4B.

In FIGS. 6A and 6B, cross-sectional views taken across the third rib 156*c* are shown, illustrating the transformation of the cushioning element 106 from the flattened configuration (FIG. 6A) when the bladder 108 is deflated to the erect configuration (FIG. 6B) when the bladder 108 is inflated. As shown, the third rib 156*c* of the webbed support structure 150*c* includes the pair of peripheral truss elements 134*h*, 134*i* and a portion of the interior truss element 134*k*. The outer legs 138*a* extend from first ends 144*a* attached to the support members 136*h*, 136*i* of the truss elements 134*h*, 134*i* to the terminal second ends 146*a* secured within respective tabs 132 of the bladder 108. While not shown, each of the outer legs 138*a* of the other peripheral truss elements 134*d*-134*g*, 134*j* are secured within the tabs 132 of the bladder 108 in a similar fashion. Optionally, the terminal second ends 146*a* of the outer legs 138*a* may have openings such as circular holes (not shown) through which the barrier layers 114, 116 are bonded to each other through the outer legs 138*a* to secure the terminal ends 146*a* of the outer legs within the tabs 132.

As discussed above, the third rib 156*c* is configured such that each of the peripheral truss elements 134*h*, 134*i* and the corresponding portion of the interior truss element 134*k* includes one of the support pillars 140, whereby three support pillars 140 are arranged in series along the width of the third rib 156*c*. As shown, the support pillar 140 of the interior truss element 134*k* may be shorter than the support pillars 140 of the peripheral truss elements 134*h*, 134*i*, whereby the distal ends of the support pillars 140 and the resulting protuberances formed in the upper barrier layer 114 cooperate to define a concave profile across the width of the support element 110.

Figure 7A:
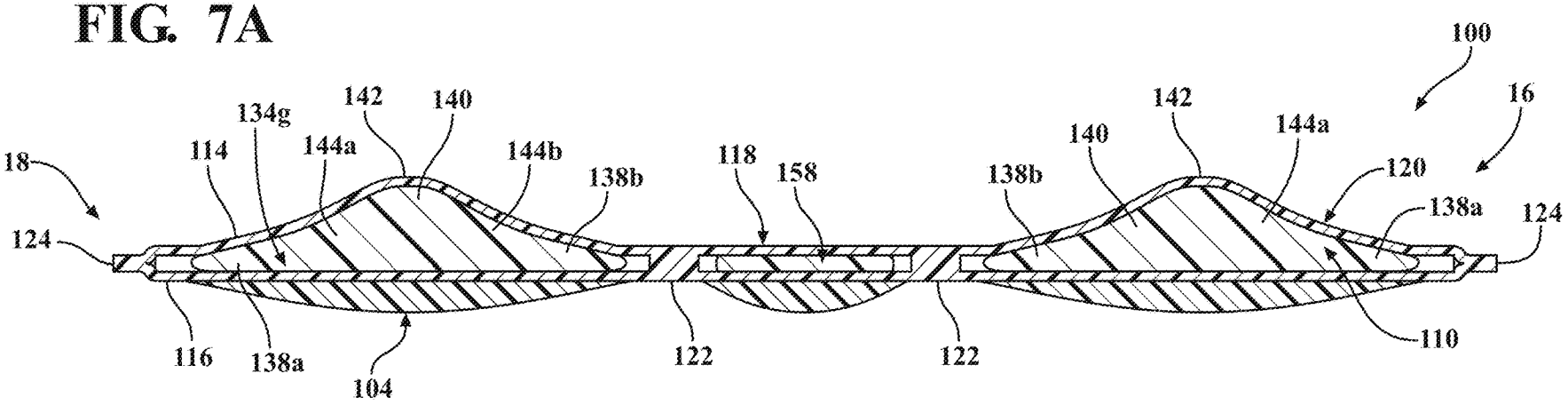
FIG. 7A is a cross-sectional view of the cushioning element of FIG. 2, taken along Line 7A-7A in FIG. 4A.
Figure 7B:
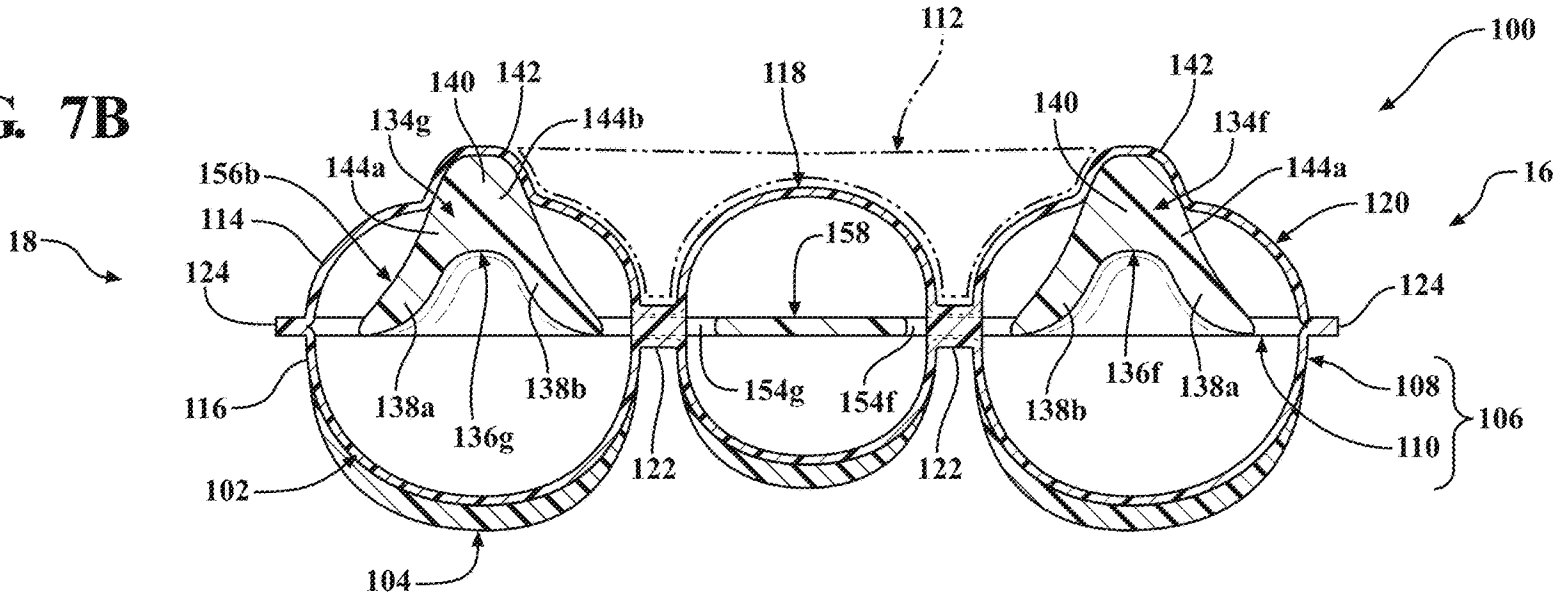
FIG. 7B is a cross-sectional view of the cushioning element of FIG. 2, taken along Line 7B-7B in FIG. 4B.

FIGS. 7A and 7B illustrates a cross-sectional view taken across the second rib 156*b*, where the cushioning element 106 transitions from the flattened state (FIG. 7A) to the erect state (FIG. 7B). As shown, the second rib 156*b* of the webbed support structure 150*c* includes the pair of the peripheral truss elements 134*f*, 134*g* and a portion of the spine 158. The upper and lower barrier layers 114, 116 are shown joined together with each other within the openings 154*f*, 154*g* of the second rib 156*b* to form a portion of the interior seam 122. Similarly, the barrier layers 114, 116 are joined together with each other at the peripheral seam 124.

Figure 8A:
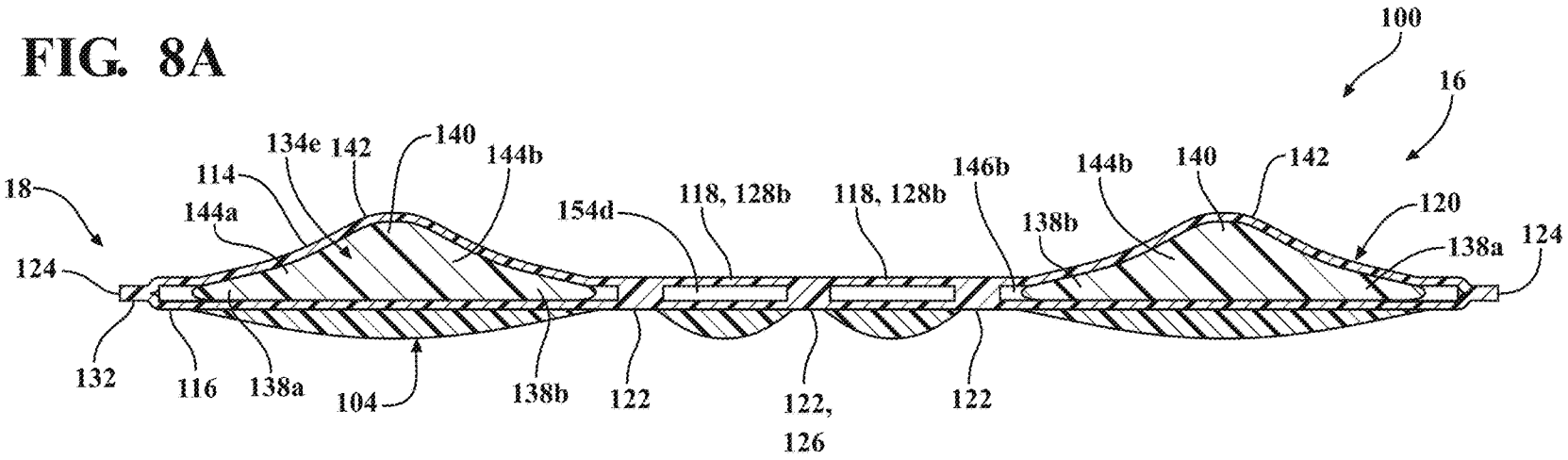
FIG. 8A is a cross-sectional view of the cushioning element of FIG. 2, taken along Line 8A-8A in FIG. 4A.
Figure 8B:
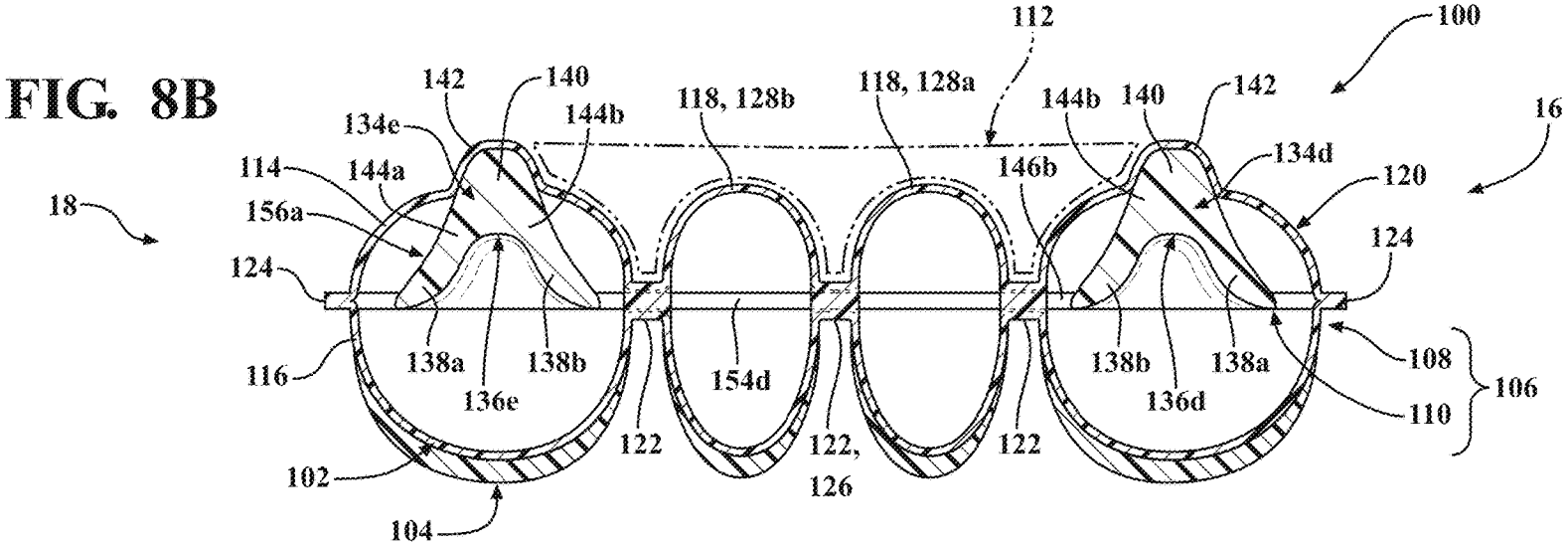
FIG. 8B is a cross-sectional view of the cushioning element of FIG. 2, taken along Line 8B-8B in FIG. 4B.

Referring to FIGS. 8A and 8B, the cross-sectional view of the first rib 156*a* is shown with the cushioning element 106 transitioned from the flattened state (FIG. 8A) to the erect state (FIG. 8B). Here, the first rib 156*a* includes the peripheral truss elements 134*d*, 134*e* in the erect configuration within the peripheral chamber 120. The upper barrier layers 114 and the lower barrier layer 116 are joined together within the opening 154*d* of the first rib 156*a* to form the interior seam 122 and the anterior leg 126 of the interior seam 122. As discussed above, the anterior leg 126 separates the anterior end of the interior chamber 118 into a pair of sub-chambers 128*a*, 128*b*.

As discussed above, the midsole 102 may optionally include a filler element 112 (shown in phantom line) or footbed received adjacent to the upper barrier layer 114 between the protuberances 142. When included, the filler 112 may cover one or more of the protuberances 142 or may be formed as a fragmentary component disposed within spaces between adjacent ones of the protuberances. The filler element 112 may include a resilient polymeric material, such as a foamed elastomer.

With continued reference to FIGS. 6A, 7A, and 8A, the cushioning element 106 is initially assembled by joining the barrier layers 114, 116 together along the interior seam 122 and the peripheral seam 124. When initially assembled, the barrier layers 114, 116 and the support element 110 are in a relaxed state. As shown, support element 110 is in a flattened configuration, whereby the legs 138*a*, 138*b* and the support members 136*a*-136*k* are substantially aligned along a common plane (i.e., coplanar). Here, the support pillars 140 protrude from a top sides of the support members 136*a*-136*k*.

In FIGS. 6B, 7B, and 8B, the cushioning element 106 is shown when the bladder 108 is inflated. Here, interior voids of the chambers 118, 120 are filled with a compressible fluid, as discussed above. The chambers 118, 120 may have the same or different pressures. When the chambers 118, 120 are filled with the compressible fluid, the upper barrier layer 114 and the lower barrier layer 116 are biased away from each other by the fluid to form the interior voids. As the barrier layers 114, 116 are biased apart, the seams 122, 124 of the bladder 108 are drawn inwardly towards a central portion of the bladder 108. Accordingly, distances between adjacent seams 122, 124 decreases. As the seams 122, 124 are drawn towards each other, the second ends 146*a*, 146*b* of the legs 138*a*, 138*b* are biased towards each other and the legs 138*a*, 138*b* flex to bias the support members 136*a*-136*k* towards the upper barrier layer 114. Where support pillars 140 are provided, the upper barrier layer 114 conforms to the distal end of the support pillars 140 to form corresponding support protuberances 142 on the top side of the cushioning element 106.

In use, the erected truss elements 134*a*-134*k* have a degree of resiliency provided by the cooperation of the flexible legs 138*a*, 138*b* and the seams 122, 124 of the bladder 108. For instance, when a compressive force (e.g., foot impact with ground) is applied to one of the truss elements 134*a*-134*k* to compress the cushioning element 106, the legs 138*a*, 138*b* of the truss element 134*a*-134*k* will splay outwardly to bias the seams 122, 124 apart. As the force increases, the fluid within the chambers 118, 120 compresses and creates a counteractive biasing force against the barrier layers 114, 116. When the counteractive force is equal to or greater than the compressive force, the splaying of the legs 138*a*, 138*b* halts and the upper barrier layer 114 is supported by the legs 138*a*, 138*b* of the truss elements 134*a*, 134*k*. When the compressive force is removed (e.g., a foot is lifted) the compressible fluid biases the barrier layers 114, 116 apart from each other and the legs 138*a*, 138*b* are biased towards each other by the seams 122, 124. The truss elements 134*a*-134*k* advantageously increase stability of the cushioning element by limiting lateral (i.e., side-to-side, front-to-back) movement of the barrier layers 114, 116.

Figure 9:
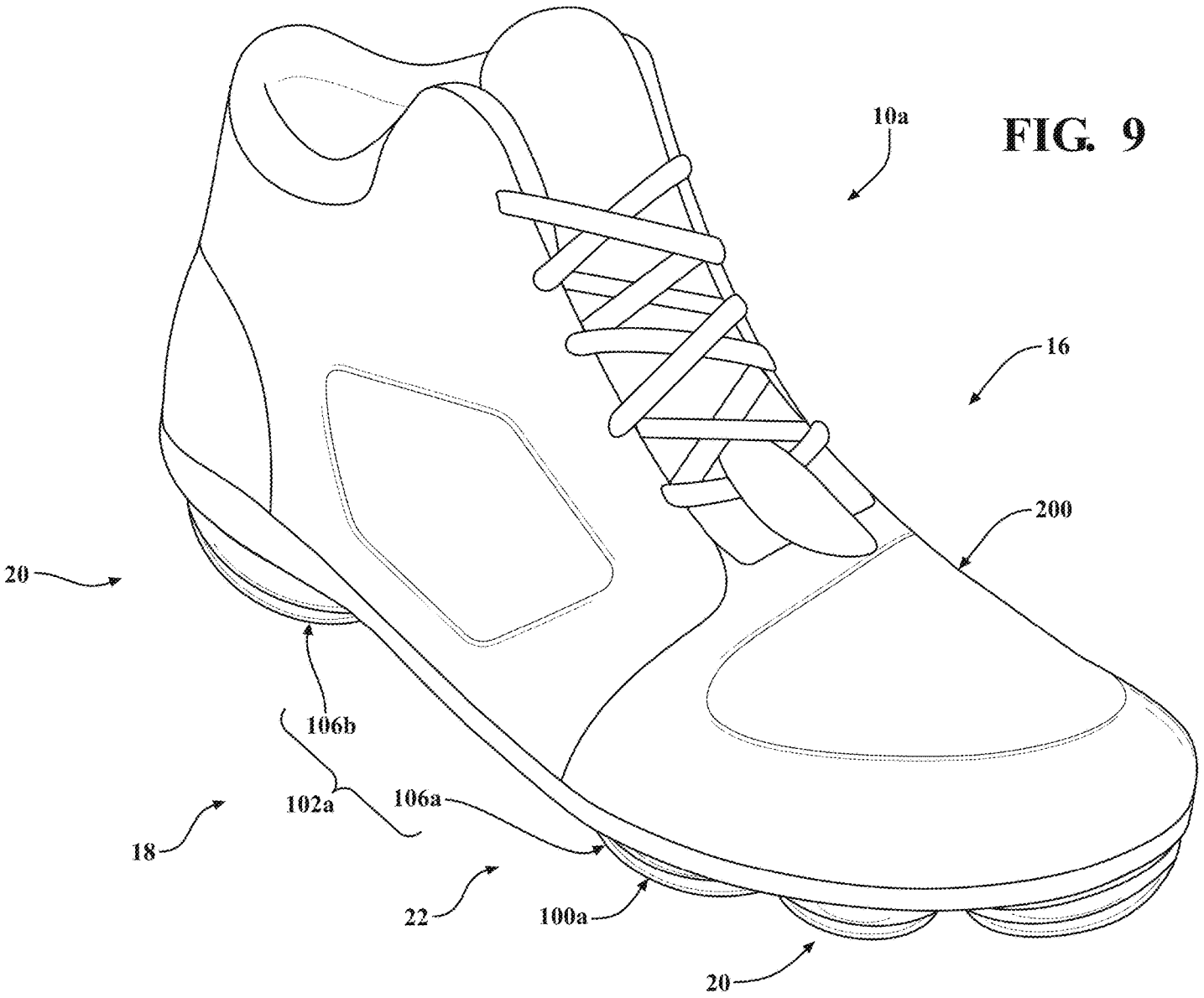
FIG. 9 is a perspective view of an article of footwear including a sole structure in accordance with the principles of the present disclosure.
Figure 10:
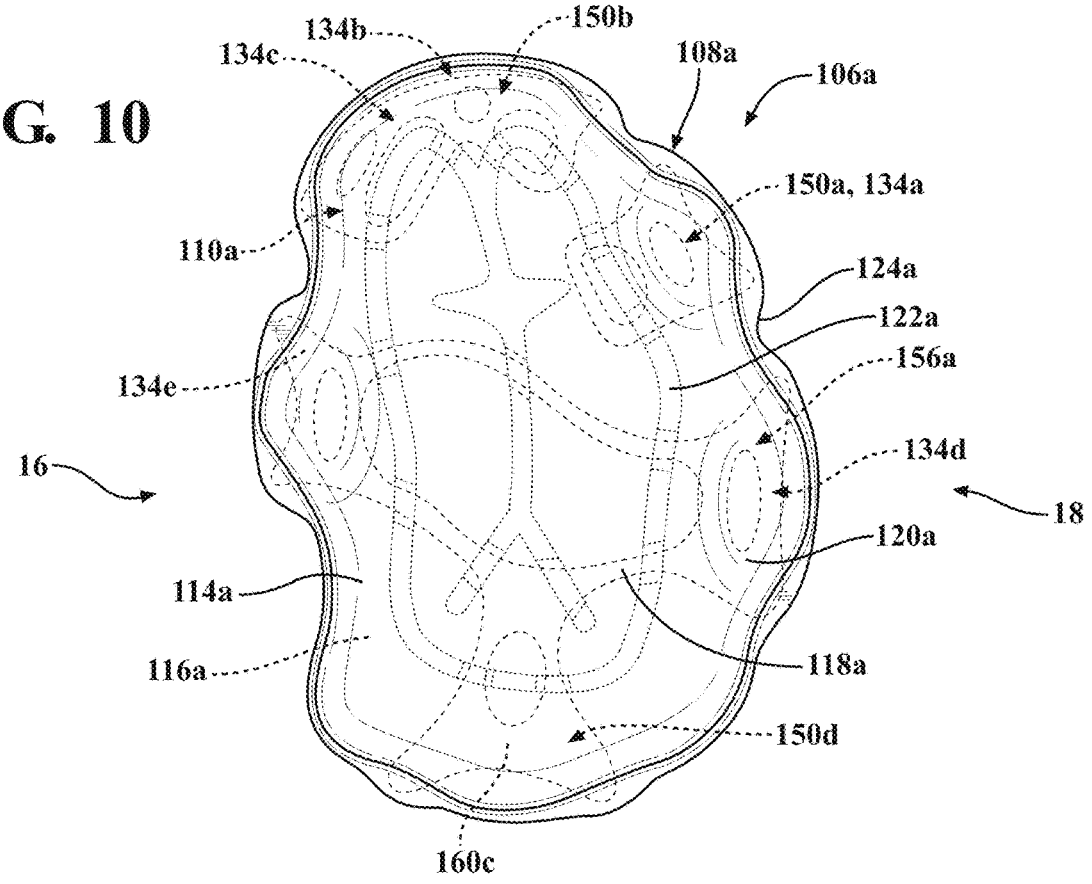
FIGS. 10 and 11 are top plan views of a cushioning element for the article of footwear of FIG. 9.
Figure 11:
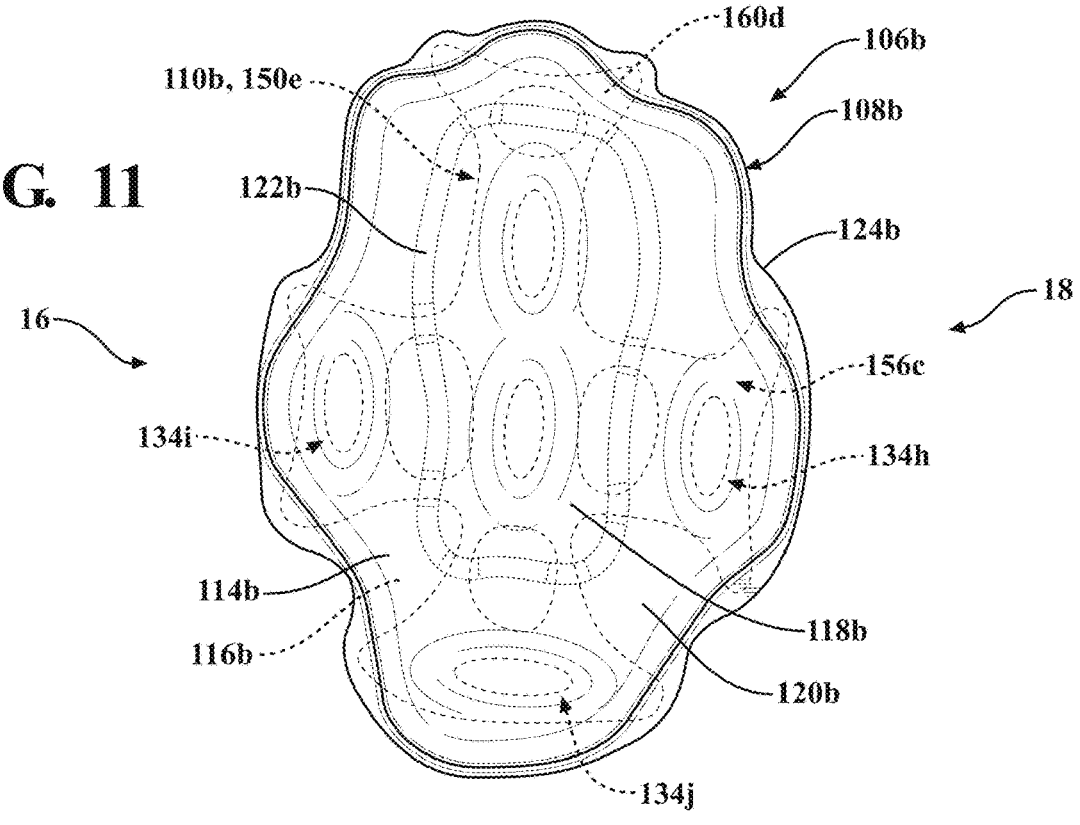

With particular reference to FIGS. 9-11, an article of footwear 10*a* is provided and includes a sole structure 100*a* and the upper 200 attached to the sole structure 100*a*. In view of the substantial similarity in structure and function of the components associated with the article of footwear 10 with respect to the article of footwear 10*a*, like reference numerals are used hereinafter and in the drawings to identify like components while like reference numerals containing letter extensions are used to identify those components that have been modified.

In the example of the sole structure 100*a* of FIGS. 9-11, the midsole 102*a* is provided as a fragmentary structure including a forefoot cushioning element 106*a* and a heel cushioning element 106*b*. Optionally, one of the cushioning elements 106*a*, 106*b* may be substituted for a conventional sole structure material, such as a compressible foam material. Each of the cushioning elements 106*a*, 106*b* is formed with substantially similar structures as the cushioning element above 106. For example, each of the cushioning elements 106*a*, 106*b* includes a bladder 108*a*, 108*b* having an interior chamber 118*a*, 118*b* and a peripheral chamber 120*a*, 120*b* formed by joining an upper barrier layer 114*a*, 114*b* together with a lower barrier layer 116*a*, 116*b* along an interior seam 122*a*, 122*b* and a peripheral seam 124*a*, 124*b*.

As shown in FIG. 10, the forefoot cushioning element 106*a* includes a forefoot support element 110*a* including the independent support structure 150*a*, the tandem support structure 150*b*, and a first webbed support structure 150*d*. The webbed support structure 150*d* includes the first rib 156*a* and a posterior connecting segment 160*c* attached to the seams 122*a*, 124*a* of the bladder 108*a*. In FIG. 11, the heel cushioning element 106*b* includes a heel support element 110*b* having a second webbed support structure 150*e* including the third rib 156*c*, the posterior truss element 134*j*, and an anterior connecting segment 160*d* attached to the seams 122*b*, 124*b* of the bladder 108*b*.

With particular reference to FIGS. 12-14*b*, a generic example of a cushioning element 106*d* incorporating the principles of the present disclosure is shown. In view of the substantial similarity in structure and function of the components associated with the cushioning element 106 with respect to the cushioning element 106*d*, like reference numerals are used hereinafter and in the drawings to identify like components while like reference numerals containing letter extensions are used to identify those components that have been modified.

Figure 12:
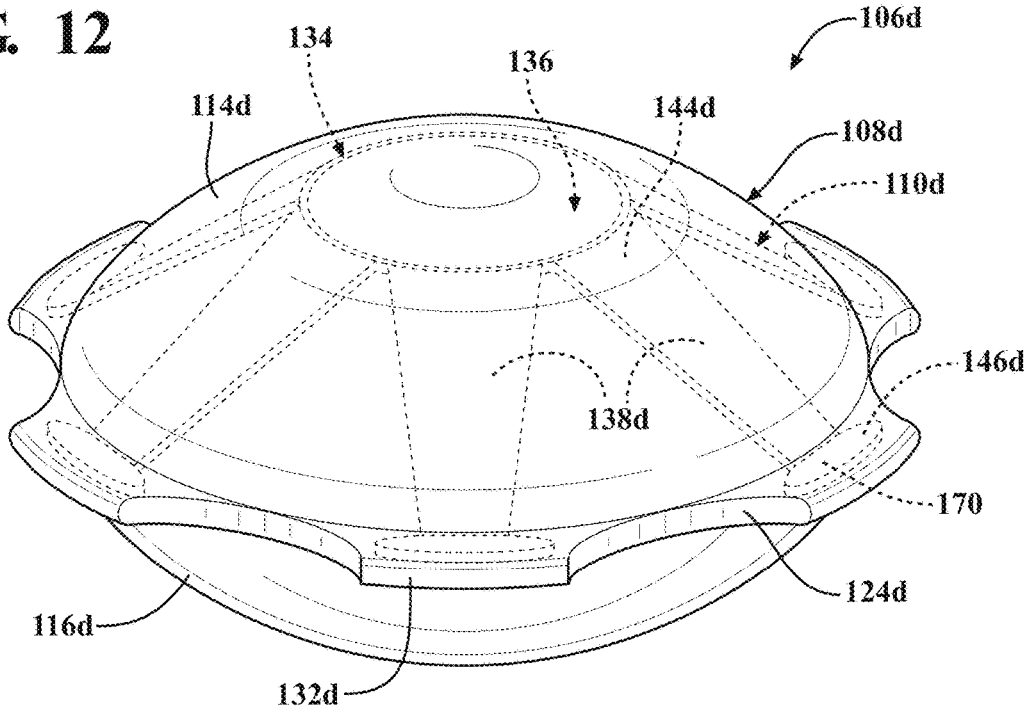
FIG. 12 is a perspective view of a cushioning element in accordance with the principles of the present disclosure.

As shown in FIG. 12, the cushioning element 106*d* includes a bladder 108*d* and a support element 110*d* captured between upper and lower barrier layers 114*d*, 116*d* of the bladder 108*d*. The upper barrier layer 114*d* is joined to the lower barrier layer 116*d* along a peripheral seam 124*d*, which includes a plurality of the tabs 132*d* formed by portions of the peripheral seam 124*d* having a greater width. The support element 110*d* of the present example includes a single truss element 134 having a support member 136 and a plurality of legs 138*d* each extending from a first end 144*d* attached to an outer periphery of the support member 136 to a distal second end 146*d* secured within one of the tabs 132*d* of the bladder 108*d*. Here, the second ends 146*d* of the legs 138*d* include anchors 170 for securing the legs 138*d* within the tabs 132. As discussed above, the legs 138*d* may include joints 172 at the first end 144*d* and/or the second end 146*d* to allow the legs 138*d* to articulate relative to the support member 136 and the anchors 170.

Figure 13A:
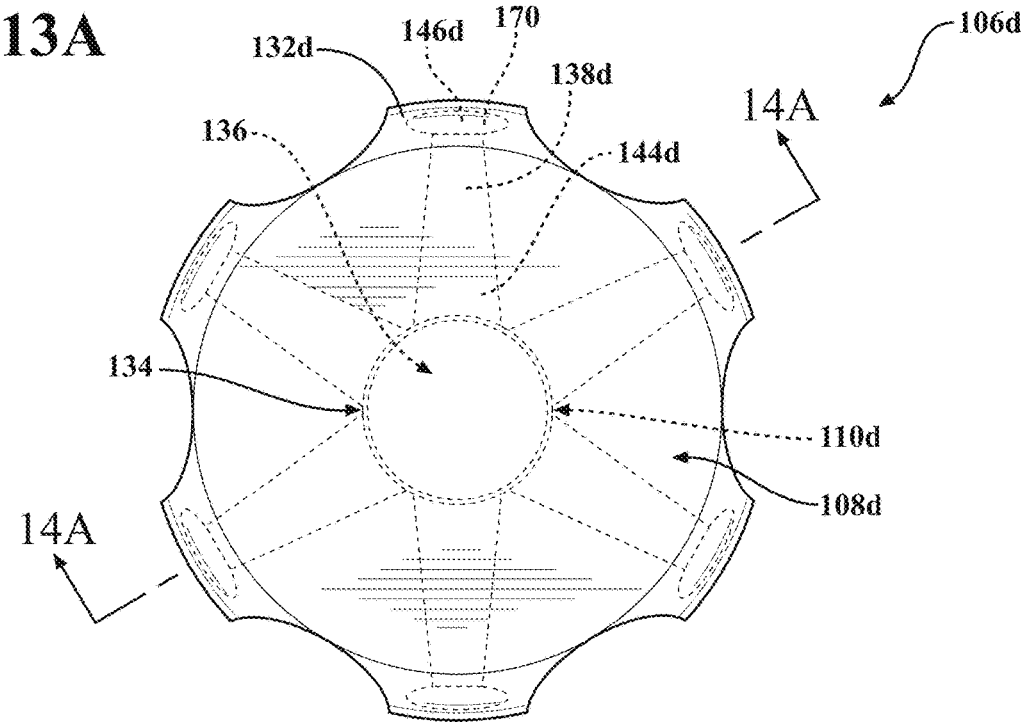
FIG. 13A is a top plan view of the cushioning element of FIG. 12, showing the cushioning element in a flattened configuration.
Figure 13B:
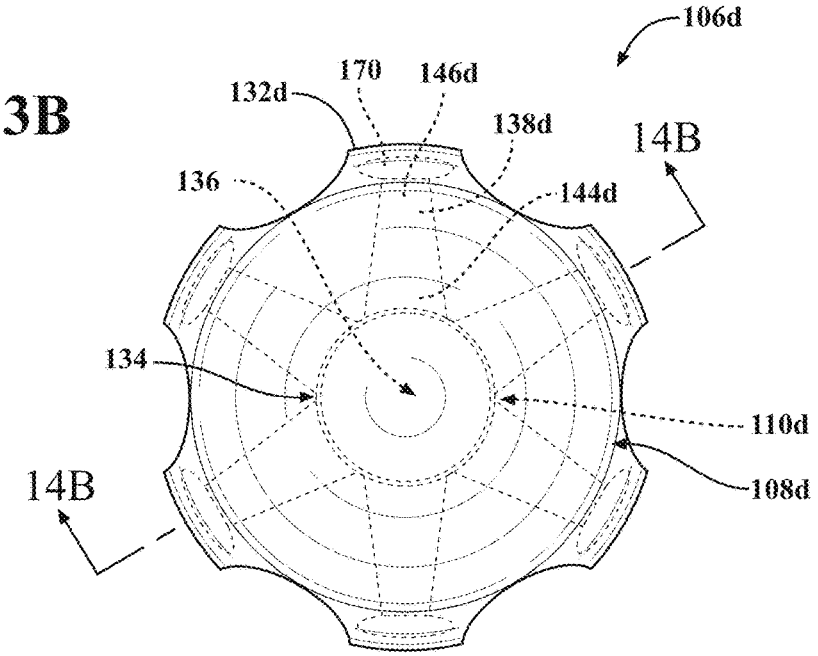
FIG. 13B is a top plan view of the cushioning element of FIG. 12, showing the cushioning element in an erect configuration.
Figure 14A:
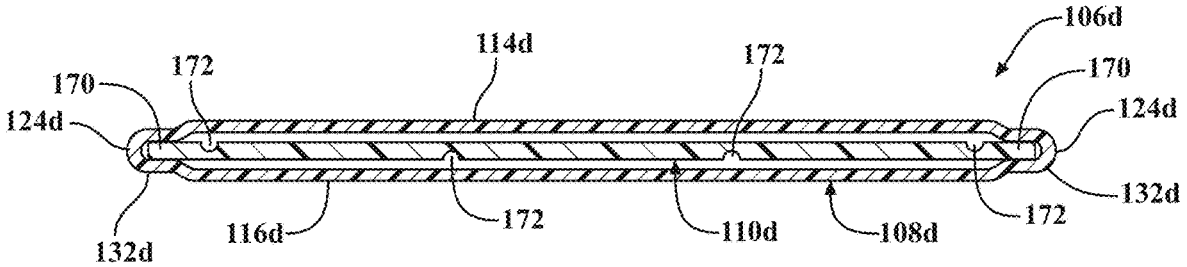
FIG. 14A is a cross-sectional view of the cushioning element of FIG. 12, taken along Line 14A-14A of FIG. 13A.
Figure 14B:
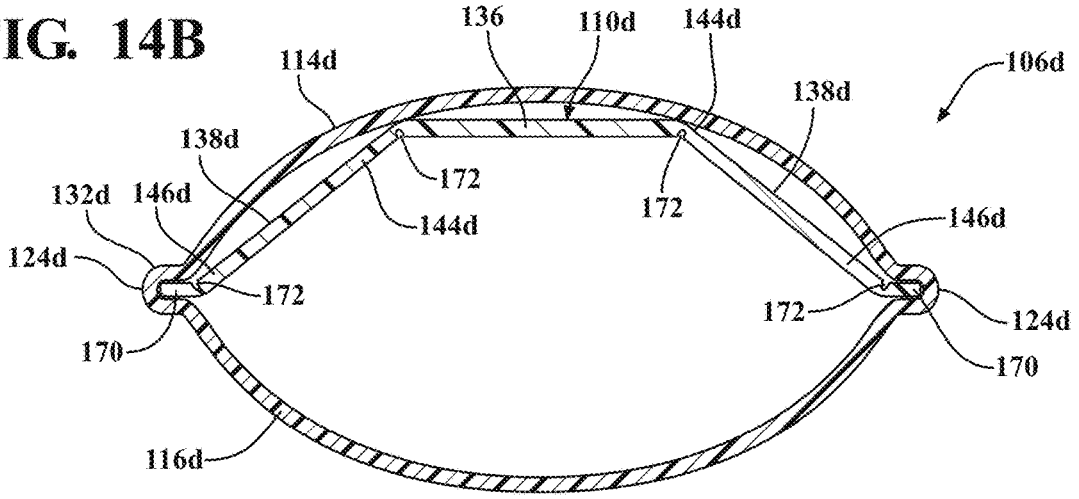
FIG. 14B is a cross-sectional view of the cushioning element of FIG. 12, taken along Line 14B-14B of FIG. 13B.

FIGS. 13A-14B illustrate the cushioning element 106*d* transitioning from a flattened configuration when the bladder 108*d* is deflated (FIGS. 13A and 14A) to an erect configuration when the bladder 108*d* is inflated (FIGS. 13B and 14B). In FIGS. 13A and 14A, the anchors 170 of the legs 138*d* of the support element 110*d* are secured within the tabs 132*d* formed by the peripheral seam 124*d* of the bladder 108*d*. Here, the bladder 108*d* is deflated and the support element 110 is in a flattened configuration. In FIGS. 13B and 14B, the bladder 108*d* is inflated such that the barrier layers 114*d*, 116*d* of the bladder 108*d* are biased apart from each other and the peripheral seam 124*d* is drawn inwardly. As the peripheral seam 124*d* is drawn inwardly, the second ends 146*d* of the legs 138*d* are biased inwardly by the peripheral seam 124*d*, causing the support member 136 to bias against the upper barrier layer 114*d*. As discussed above, the use of the support element 110*d* including the truss element 134 increases stability of the cushioning element 106*d* by restricting lateral movement of the upper barrier layer 114*d* relative to the lower barrier layer 116*d*.

The following Clauses provide an exemplary configuration for a cushioning element for an article of footwear and related method described above.

Clause 1. A cushioning element for an article of footwear, the cushioning element comprising a bladder including a first barrier layer and a second barrier layer joined together along a seam to define a chamber and a support element disposed within the chamber and including a support member and a plurality of flexible support legs each extending from a first end attached to the support member to a second end disposed between the first barrier layer and the second barrier layer within the seam.

Clause 2. The cushioning element of Clause 1, wherein the support element is operable between a flat configuration when the bladder is in a deflated state and an erect configuration when the bladder is in an inflated state.

Clause 3. The cushioning element of Clause 2, wherein in the erect configuration, the second end of each of the support legs is biased towards the second end of at least one of the other support legs.

Clause 4. The cushioning element of Clause 2, wherein in the erect configuration, the support element is biased towards the first barrier layer and away from the second barrier layer.

Clause 5. The cushioning element of any of the preceding Clauses, wherein the seam is a peripheral seam extending around an outer periphery of the bladder and forms a plurality of tabs.

Clause 6. The cushioning element of Clause 5, wherein the second end of each of the support legs is secured between the first barrier layer and the second barrier layer within one of the tabs.

Clause 7. The cushioning element of Clause 6, wherein the second end of each of the support legs includes an anchor captured within one of the tabs.

Clause 8. The cushioning element of any of the preceding Clauses, wherein the support member includes a support pillar extending towards the first barrier layer from the support member to a distal end.

Clause 9. The cushioning element of Clause 8, wherein the first barrier layer conforms to the distal end of the support pillar and forms a protuberance in the first barrier layer.

Clause 10. The cushioning element of any of the preceding Clauses, wherein each of the first barrier layer and the second barrier layer includes a striated polymeric material.

Clause 11. A cushioning element for an article of footwear, the cushioning element comprising a support element including a support member and a plurality of support legs each extending from a first end attached to an outer periphery of the support member to a distal end, each of the support legs including a portion that is flexible relative to the support member and a bladder including a first barrier layer and a second barrier layer joined together along a peripheral seam, the distal end of each of the support legs being secured within the peripheral seam.

Clause 12. The cushioning element of Clause 11, wherein the support element is operable between a flat configuration when the bladder is in a deflated state and an erect configuration when the bladder is in an inflated state.

Clause 13. The cushioning element of Clause 12, wherein in the erect configuration, the distal end of each of the support legs is biased towards the distal end of at least one of the other support legs.

Clause 14. The cushioning element of Clause 12, wherein in the erect configuration, the support member is biased towards the first barrier layer and away from the second barrier layer.

Clause 15. The cushioning element of any of the preceding Clauses, wherein the peripheral seam extends around an outer periphery of the bladder and forms a plurality of tabs.

Clause 16. The cushioning element of Clause 15, wherein the distal end of each of the support legs is secured between the first barrier layer and the second barrier layer within one of the tabs.

Clause 17. The cushioning element of Clause 16, wherein the distal end of each of the support legs includes an anchor captured within one of the tabs.

Clause 18. The cushioning element of any of the preceding Clauses, wherein the support member includes a support pillar extending from the support member to a distal end.

Clause 19. The cushioning element of Clause 18, wherein the first barrier layer conforms to the distal end of the support pillar and forms a protuberance in the first barrier layer.

Clause 20. The cushioning element of any of the preceding Clauses, wherein each of the first barrier layer and the second barrier layer includes a striated polymeric material.

Clause 21. An article of footwear including a cushioning element of any of the preceding Clauses.

Clause 22. A method of forming a cushioning element for an article of footwear, the method comprising the steps of forming a support element including a support member and a plurality of support legs extending outwardly from a first end attached to an outer periphery of the support member to a terminal distal end, providing a first barrier layer on a first side of the support element, providing a second barrier layer on an opposite side of the support element than the first barrier layer, joining the first barrier layer to the second barrier layer along a peripheral seam to form a bladder, the support element disposed within the bladder and the terminal distal end of each of the support legs secured within the peripheral seam, and inflating the bladder with a pressurized fluid to bias the support element of the support member towards the first barrier layer.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

The invention claimed is:

1. A cushioning element for an article of footwear, the cushioning element comprising:

a bladder including a first barrier layer and a second barrier layer joined together along a seam to define a chamber, the seam including a peripheral seam extending around an outer periphery of the bladder; and a support element disposed within the chamber and including a first distal end disposed and secured in the peripheral seam and a second distal end disposed and secured in the peripheral seam, the support element having a variable cross-section between the first distal end and the second distal end.

2. The cushioning element of claim 1, wherein the support element includes at least one protuberance and an area of reduced thickness between the first distal end and the second distal end.

3. The cushioning element of claim 2, wherein the first barrier layer is bonded to the support element at the area of reduced thickness to form a first bond and the second barrier layer is bonded to the support element at the area of reduced thickness to form a second bond.

4. The cushioning element of claim 3, wherein the first bond opposes the second bond across the support element at the area of reduced thickness.

5. The cushioning element of claim 3, wherein the first bond is aligned with the second bond.

6. The cushioning element of claim 3, wherein the first bond is located on an opposite side of the support element than the second bond.

7. The cushioning element of claim 2, wherein the support element is operable between a flat configuration when the bladder is in a deflated state and an erect configuration when the bladder is in an inflated state.

8. The cushioning element of claim 7, wherein in the erect configuration, the support element is biased towards the first barrier layer and away from the second barrier layer.

9. The cushioning element of claim 7, wherein the at least one protuberance includes a convex surface opposing and in contact with the first barrier layer when the bladder is in the deflated state and when the bladder is in the inflated state.

10. The cushioning element of claim 9, wherein the at least one protuberance includes a substantially planar surface opposing and in contact with the second barrier layer when the bladder is in the deflated state, the substantially planar surface defining a concave surface that is spaced apart from the second barrier layer when the bladder is in the inflated state.

11. A cushioning element for an article of footwear, the cushioning element comprising:

a bladder including a first barrier layer and a second barrier layer joined together along a seam to define a chamber, the seam including a peripheral seam extending around an outer periphery of the bladder; and a support element disposed within the chamber and including a first distal end disposed and secured in the peripheral seam, a second distal end disposed and secured in the peripheral seam, a first protuberance, and a second protuberance spaced apart from the first protuberance, the first protuberance and the second protuberance disposed between the first distal end and the second distal end.

12. The cushioning element of claim 11, wherein the support element includes an area of reduced thickness between the first protuberance and the second protuberance.

13. The cushioning element of claim 12, wherein the first barrier layer is bonded to the support element at the area of reduced thickness to form a first bond and the second barrier layer is bonded to the support element at the area of reduced thickness to form a second bond.

14. The cushioning element of claim 13, wherein the first bond opposes the second bond across the support element at the area of reduced thickness.

15. The cushioning element of claim 13, wherein the first bond is aligned with the second bond.

16. The cushioning element of claim 13, wherein the first bond is located on an opposite side of the support element than the second bond.

17. The cushioning element of claim 11, wherein the support element is operable between a flat configuration when the bladder is in a deflated state and an erect configuration when the bladder is in an inflated state.

18. The cushioning element of claim 17, wherein in the erect configuration, the support element is biased towards the first barrier layer and away from the second barrier layer.

19. The cushioning element of claim 17, wherein the first protuberance and the second protuberance each includes a convex surface opposing and in contact with the first barrier layer when the bladder is in the deflated state and when the bladder is in the inflated state.

20. The cushioning element of claim 19, wherein the first protuberance and the second protuberance each includes a substantially planar surface opposing and in contact with the second barrier layer when the bladder is in the deflated state, the substantially planar surface defining a concave surface that is spaced apart from the second barrier layer when the bladder is in the inflated state.

* * * * *